US011424570B2

(12) United States Patent
Sekino et al.

(10) Patent No.: US 11,424,570 B2
(45) Date of Patent: Aug. 23, 2022

(54) CONNECTOR

(71) Applicant: Yazaki Corporation, Tokyo (JP)

(72) Inventors: Tetsuya Sekino, Shizuoka (JP); Toshinori Yamamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 117 days.

(21) Appl. No.: 17/146,458

(22) Filed: Jan. 11, 2021

(65) Prior Publication Data

US 2021/0218179 A1 Jul. 15, 2021

(30) Foreign Application Priority Data

Jan. 15, 2020 (JP) ..... JP2020-004222

(51) Int. Cl.

| | |
|---|---|
| ***H01R 13/60*** | (2006.01) |
| ***H01R 13/518*** | (2006.01) |
| ***H01R 13/502*** | (2006.01) |
| ***H01R 13/514*** | (2006.01) |
| ***H01R 13/74*** | (2006.01) |

(52) U.S. Cl.

CPC ..... *H01R 13/518* (2013.01); *H01R 13/502* (2013.01); *H01R 13/514* (2013.01); *H01R 13/74* (2013.01)

(58) Field of Classification Search

CPC .. H01R 13/516; H01R 13/518; H01R 13/502; H01R 13/514; H01R 13/74

USPC ..... 439/540.1, 541.5

See application file for complete search history.

(56) References Cited

U.S. PATENT DOCUMENTS

| | | | | |
|---|---|---|---|---|
| 9,502,812 | B2 | 11/2016 | Akagi et al. | |
| 9,837,749 | B2 * | 12/2017 | Furuya | H01R 13/4538 |
| 11,349,256 | B2 * | 5/2022 | Sekino | H01R 13/506 |
| 2012/0077375 | A1 | 3/2012 | Dietz et al. | |

FOREIGN PATENT DOCUMENTS

| | | | |
|---|---|---|---|
| JP | H10-14667 | A | 1/1998 |
| JP | 2000-91035 | A | 3/2000 |
| JP | 2011-108420 | A | 6/2011 |
| JP | 2016-85897 | A | 5/2016 |

* cited by examiner

*Primary Examiner* — Khiem M Nguyen
(74) *Attorney, Agent, or Firm* — Kenealy Vaidya LLP

(57) ABSTRACT

A connector includes: an outer housing that includes an inserting part having a tubular shape, and is fixed to a first surface of a wall part in a state in which the inserting part is inserted into a hole part of the wall part; and an inner housing including a main body that is inserted into the hole part from a second surface side to be engaged with the outer housing, and a projecting part projecting from the main body. The projecting part projects from the main body toward a rear side in an insertion direction with respect to the hole part, and is configured such that a rear end surface of the projecting part is located to be flush with the second surface when the main body is completely engaged with the outer housing.

14 Claims, 22 Drawing Sheets

CONNECTOR

CROSS-REFERENCE TO RELATED APPLICATION(S)

The present application claims priority to and incorporates by reference the entire contents of Japanese Patent Application No. 2020-004222 filed in Japan on Jan. 15, 2020.

BACKGROUND OF THE INVENTION

1. Field of the Invention

The present invention relates to a connector.

2. Description of the Related Art

In the related art, there is known a connector including a plurality of housings. Japanese Patent Application Laid-open No. 2016-85897 discloses a connector including a pair of connector housings, an engaging part disposed in one of the connector housings, and a part to be engaged disposed in the other one of the connector housings.

In a case in which the connector includes an outer housing and an inner housing, it is preferable to easily determine whether the outer housing and the inner housing are completely engaged with each other by visual check.

SUMMARY OF THE INVENTION

It is an object of the present invention to provide a connector with which whether an outer housing and an inner housing are completely engaged with each other can be easily determined by visual check.

In order to achieve the above mentioned object, a connector according to one aspect of the present invention includes an outer housing that includes an inserting part having a tubular shape, and is fixed to a first surface of a wall part in a state in which the inserting part is inserted into a hole part of the wall part; and an inner housing including a main body that is inserted into the hole part from a second surface side to be engaged with the outer housing, and a projecting part projecting from the main body, wherein the projecting part projects from the main body toward a rear side in an insertion direction with respect to the hole part, and is configured such that a rear end surface of the projecting part is located to be flush with the second surface when the main body is completely engaged with the outer housing.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes a connector according to an embodiment of the present invention in detail with reference to the drawings. The present invention is not limited to the embodiment. Constituent elements in the embodiment described below include a constituent element that is easily conceivable by those skilled in the art, or substantially the same constituent element.

Embodiment

Figure 1:
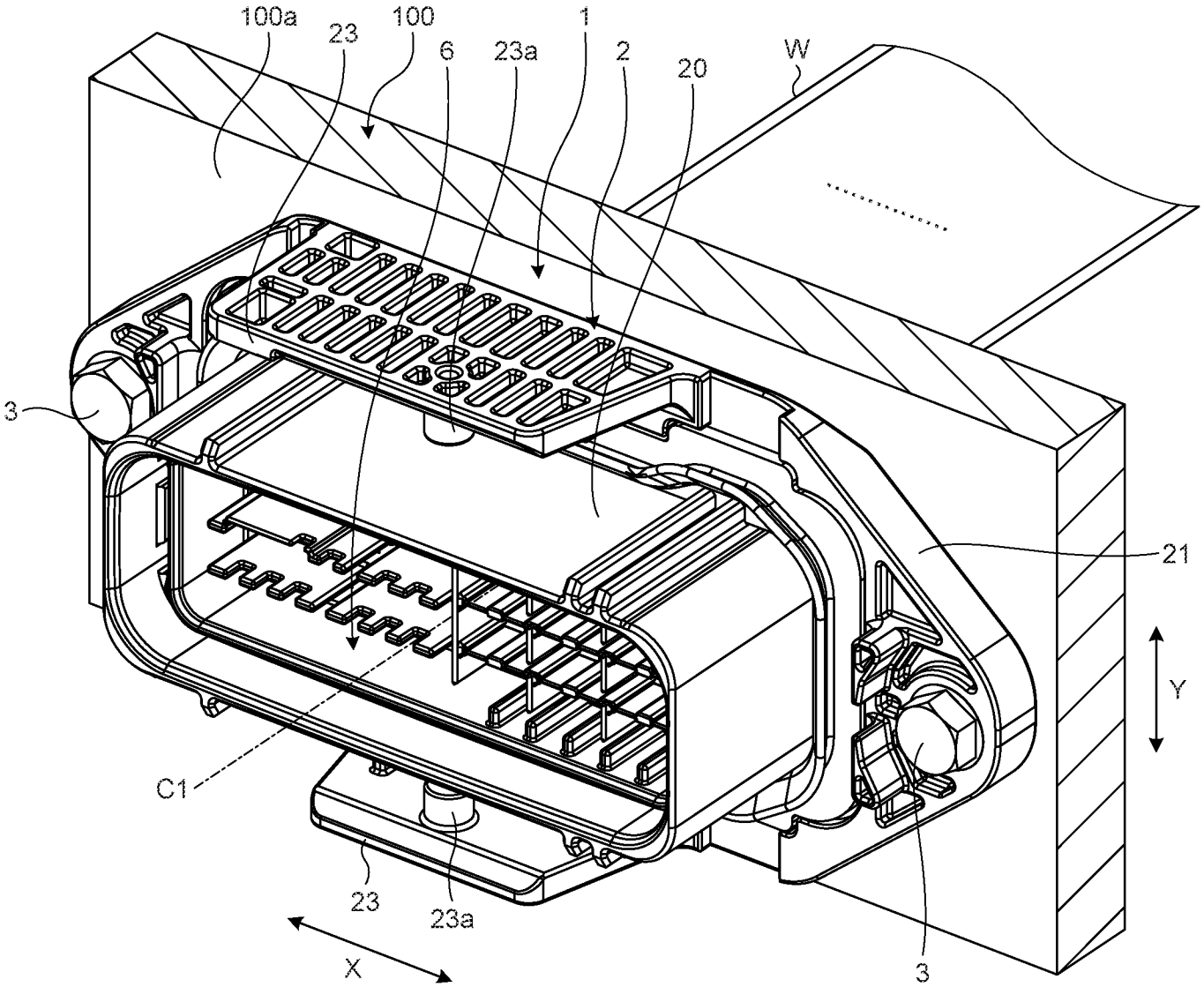
FIG. 1 is a perspective view illustrating a connector according to an embodiment.
Figure 2:
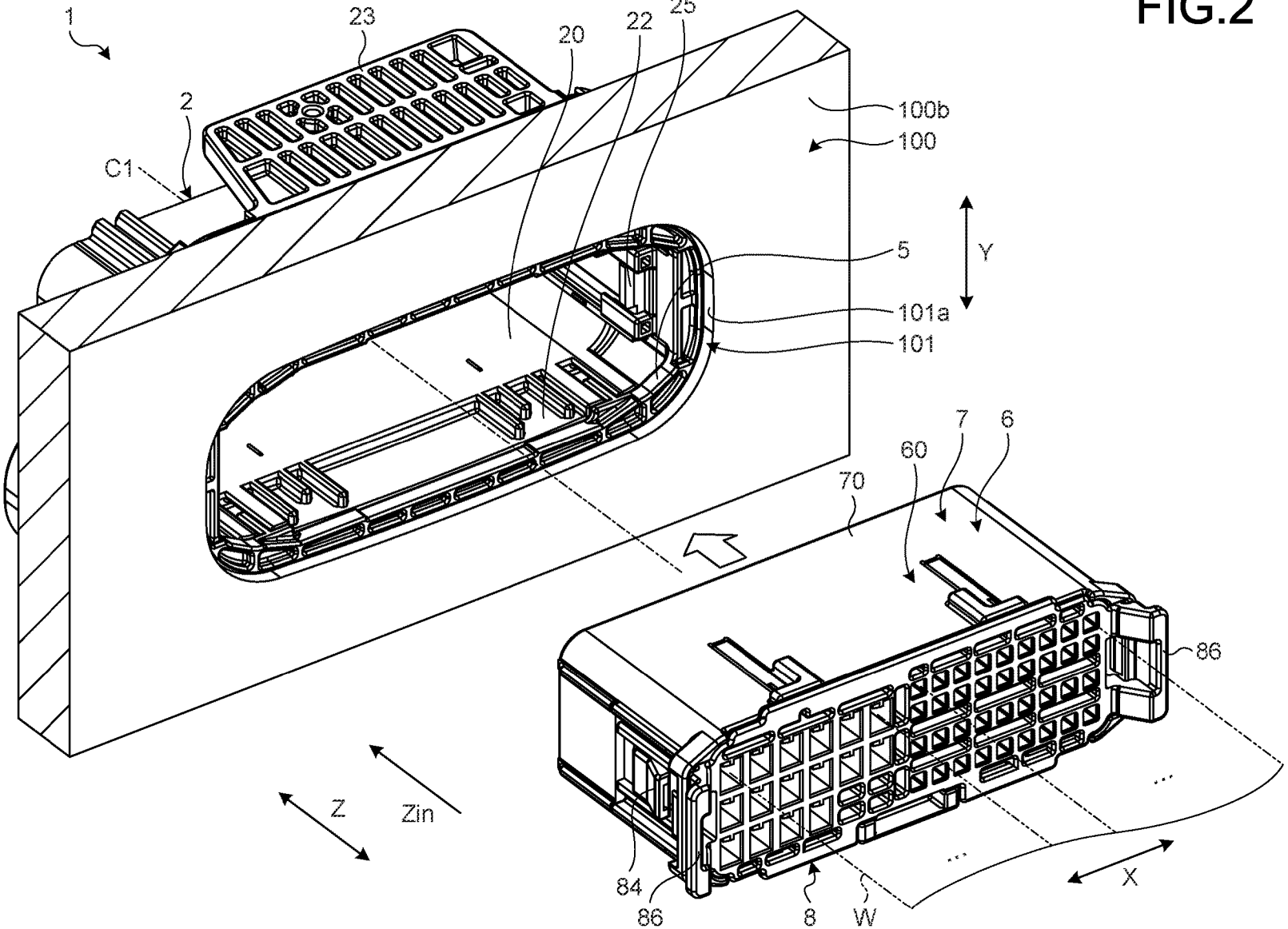
FIG. 2 is a diagram illustrating an inner housing to be inserted into an outer housing.
Figure 3:
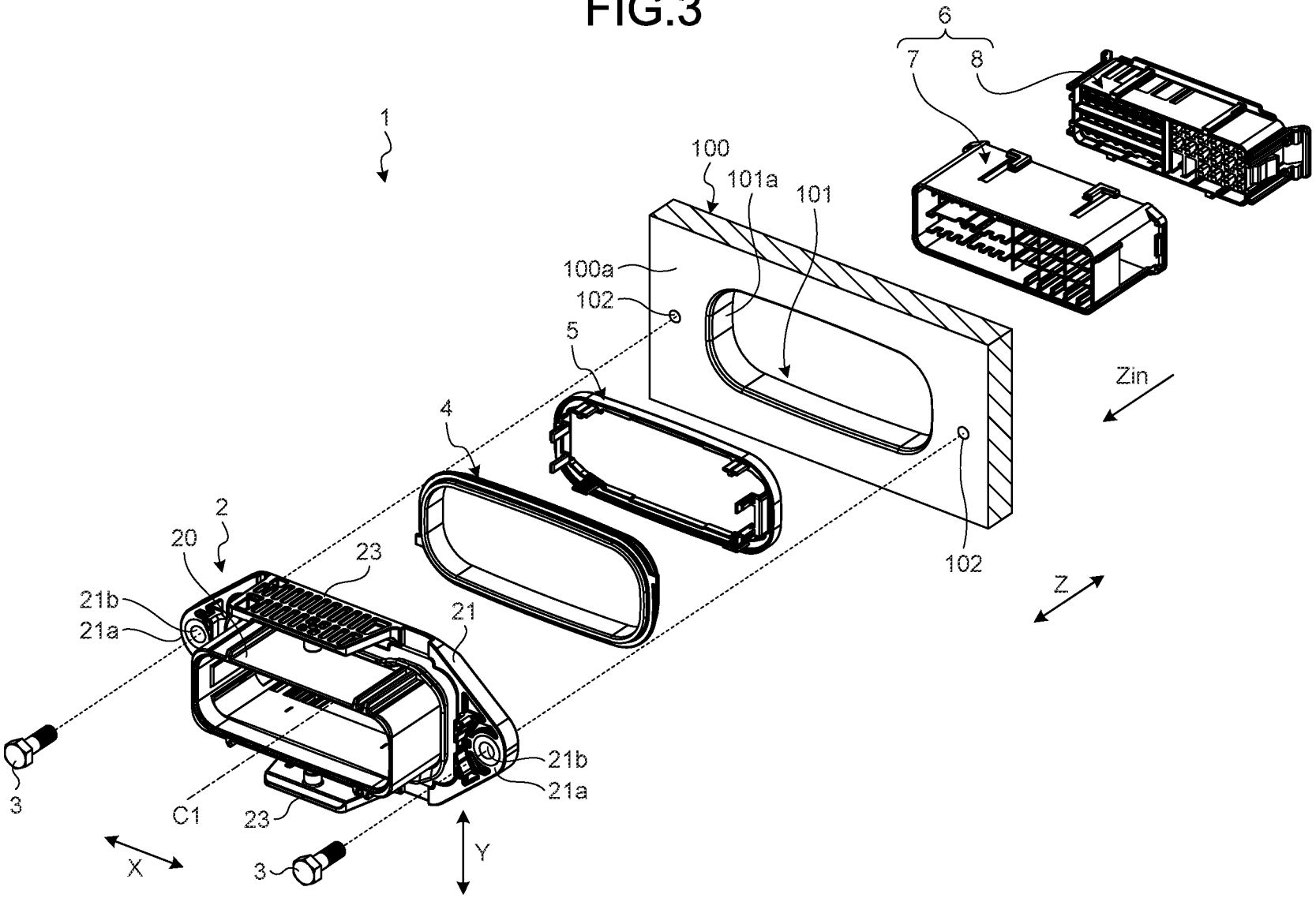
FIG. 3 is an exploded perspective view of the connector according to the embodiment.
Figure 4:
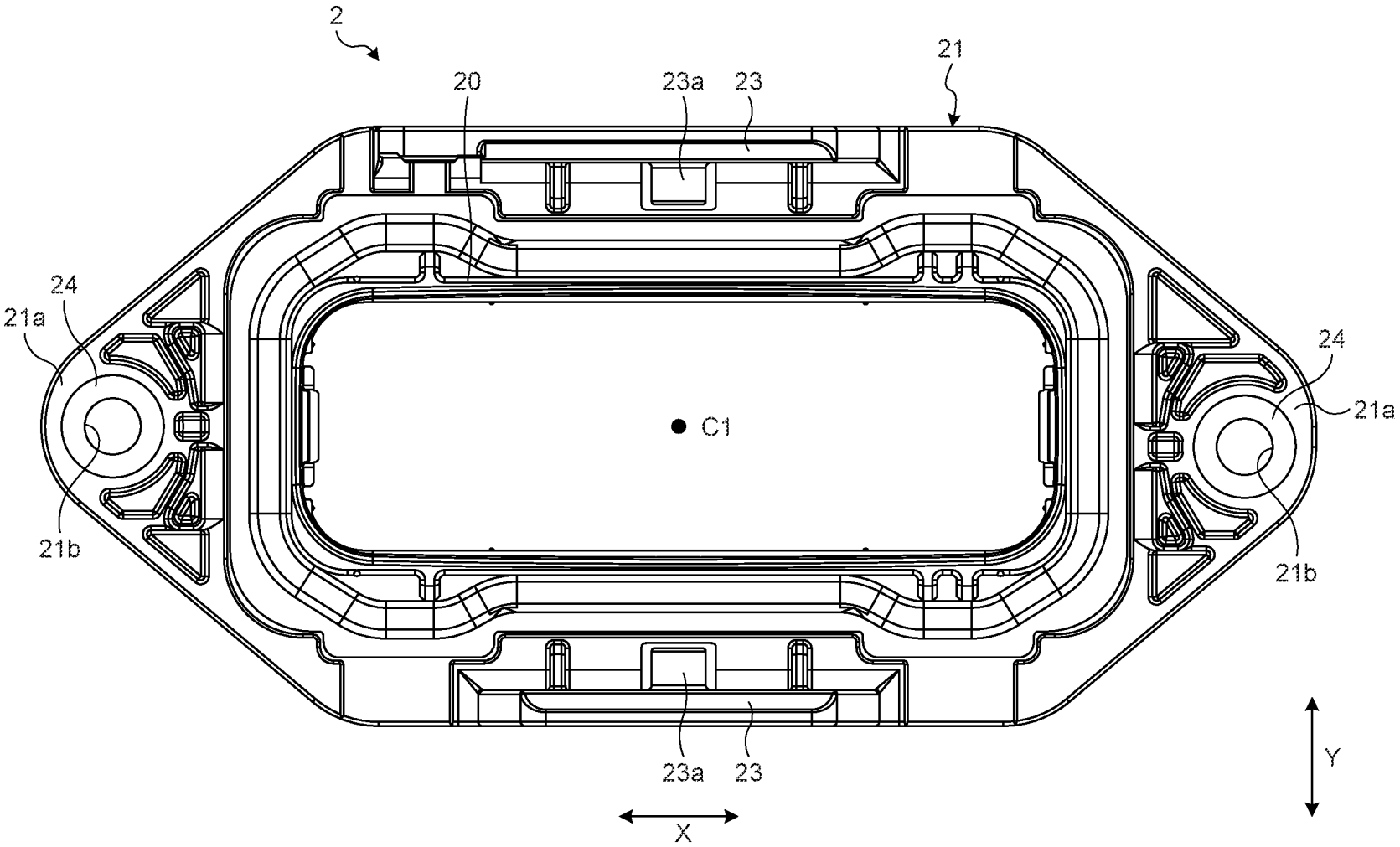
FIG. 4 is a front view of the outer housing according to the embodiment.
Figure 5:
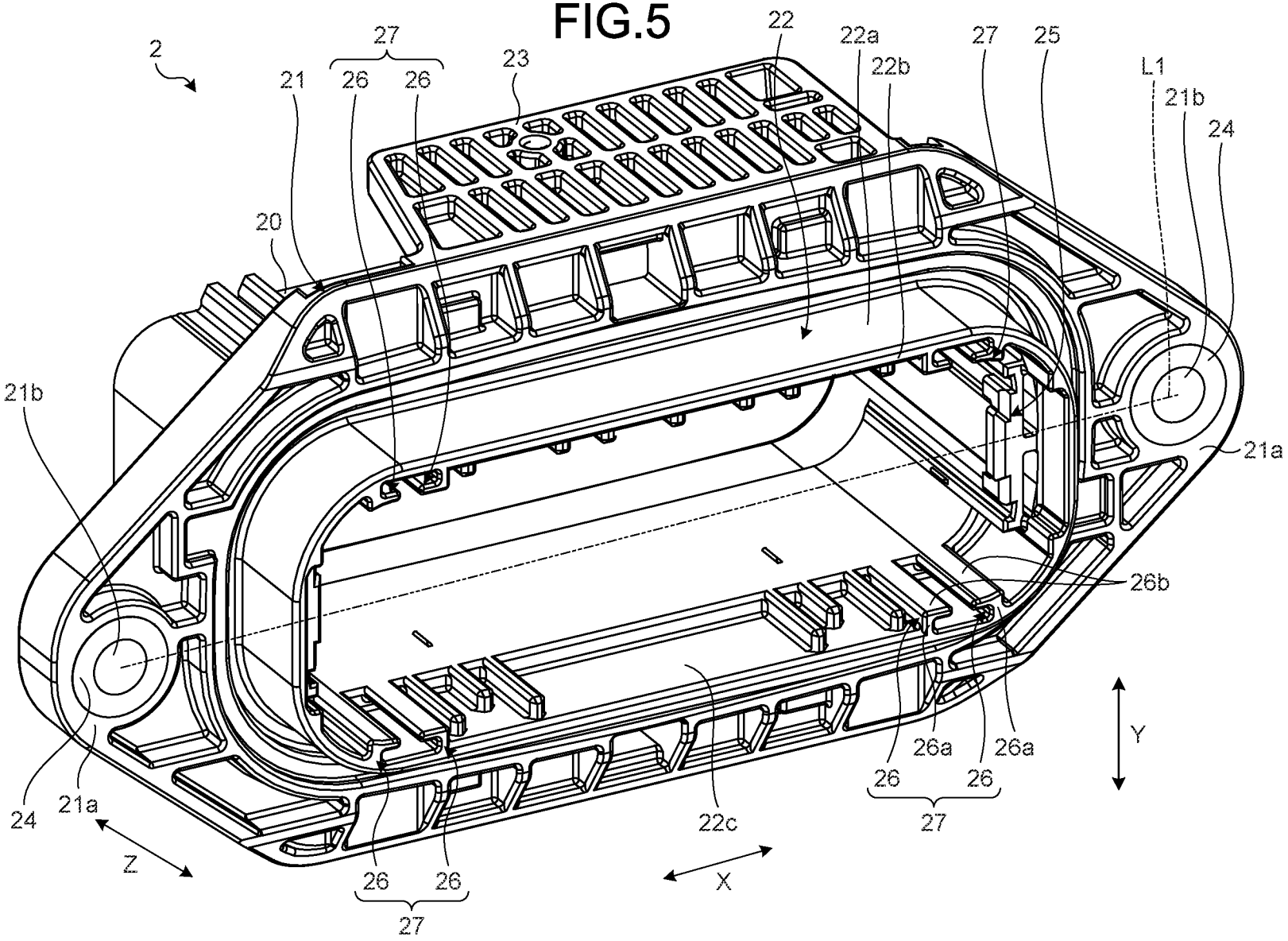
FIG. 5 is a perspective view of the outer housing according to the embodiment.
Figure 6:
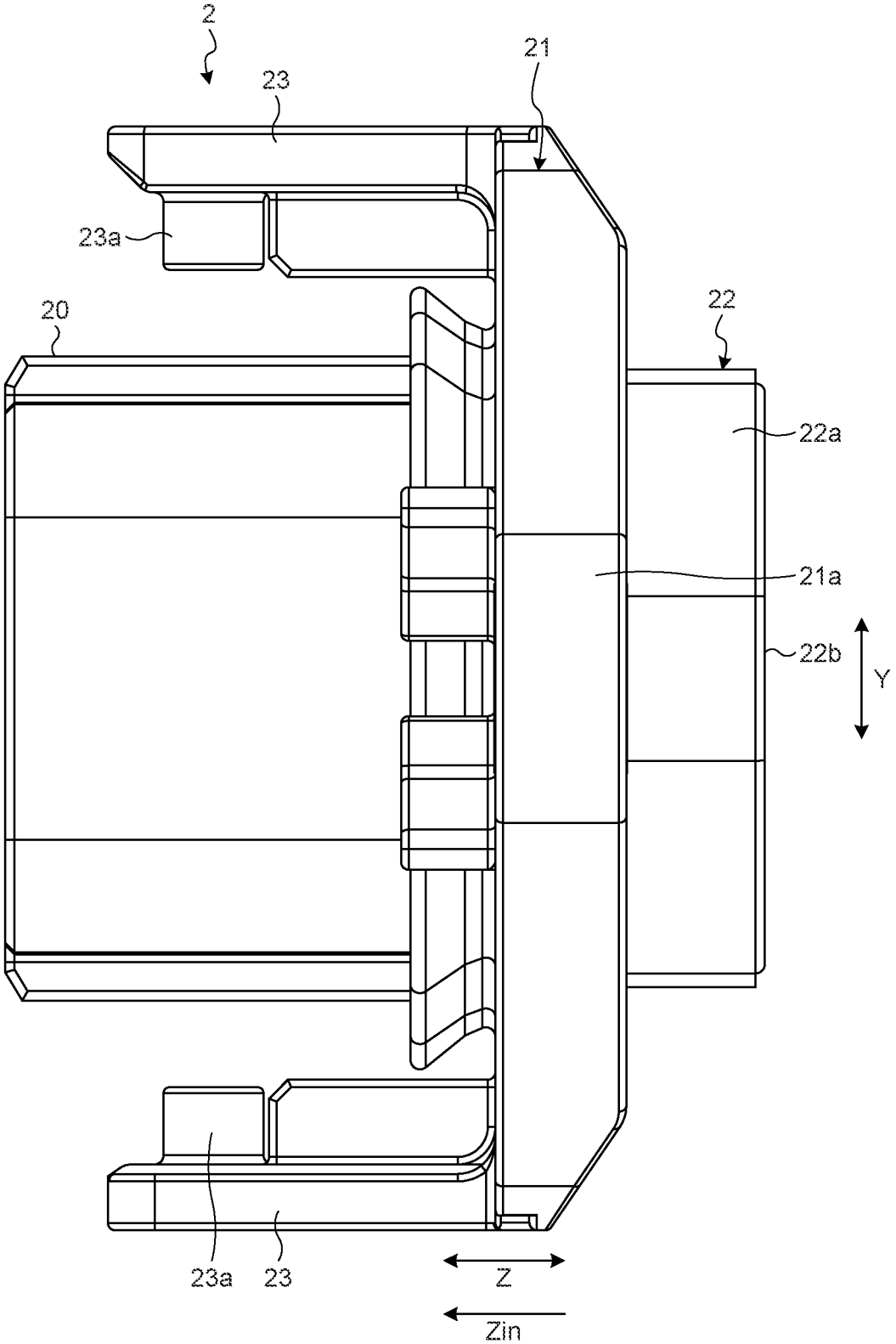
FIG. 6 is a side view of the outer housing according to the embodiment.
Figure 7:
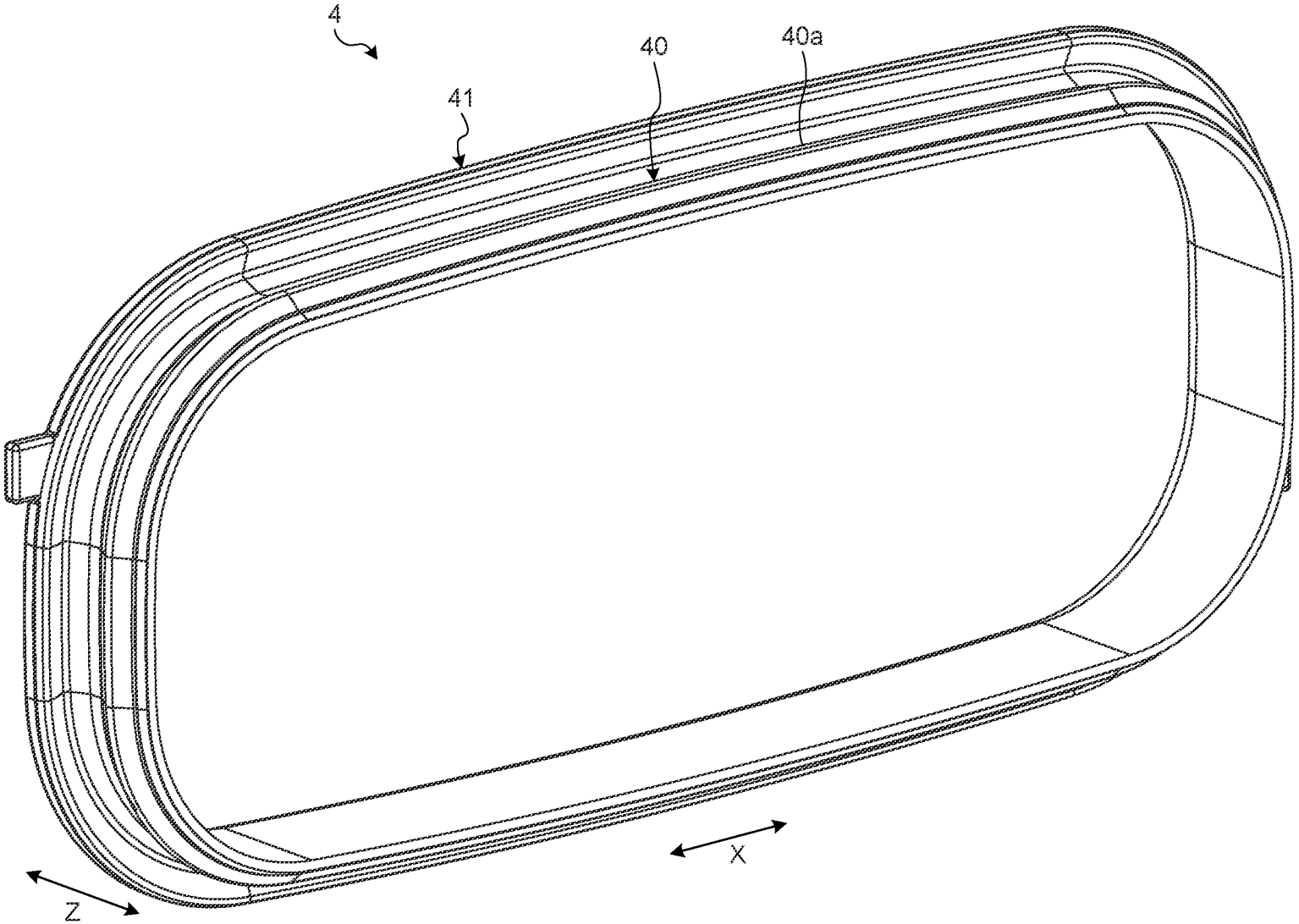
FIG. 7 is a perspective view of a sealing member according to the embodiment.
Figure 8:
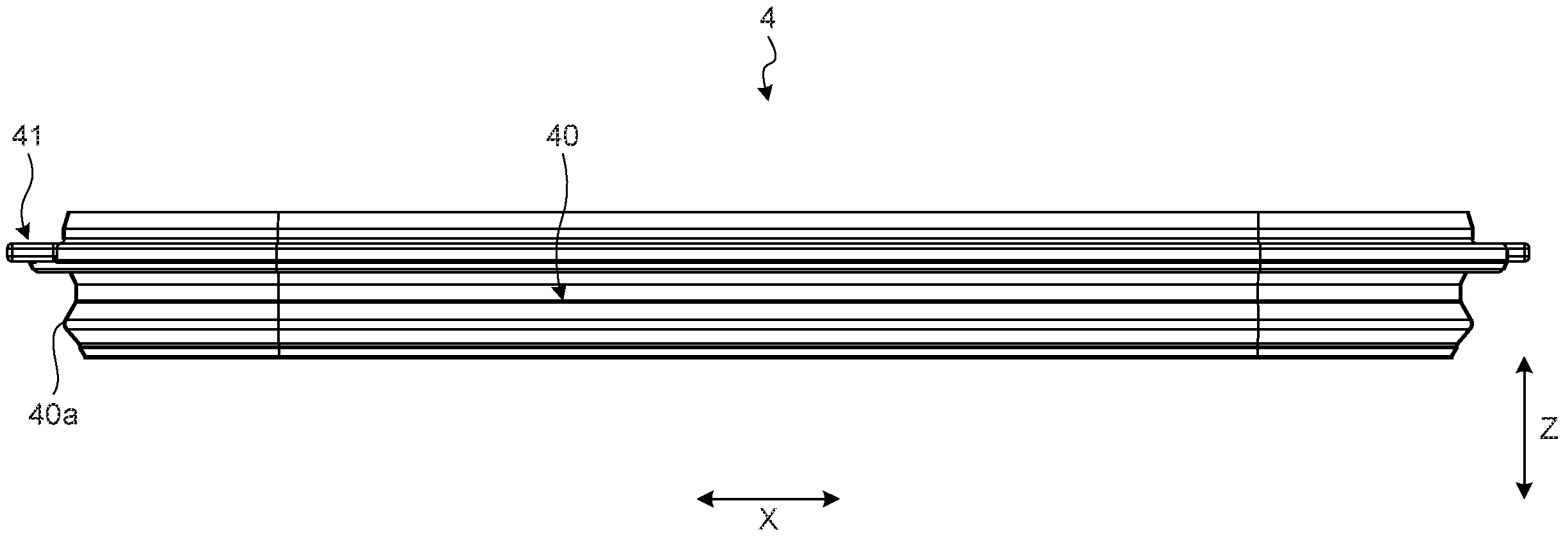
FIG. 8 is a side view of the sealing member according to the embodiment.
Figure 9:
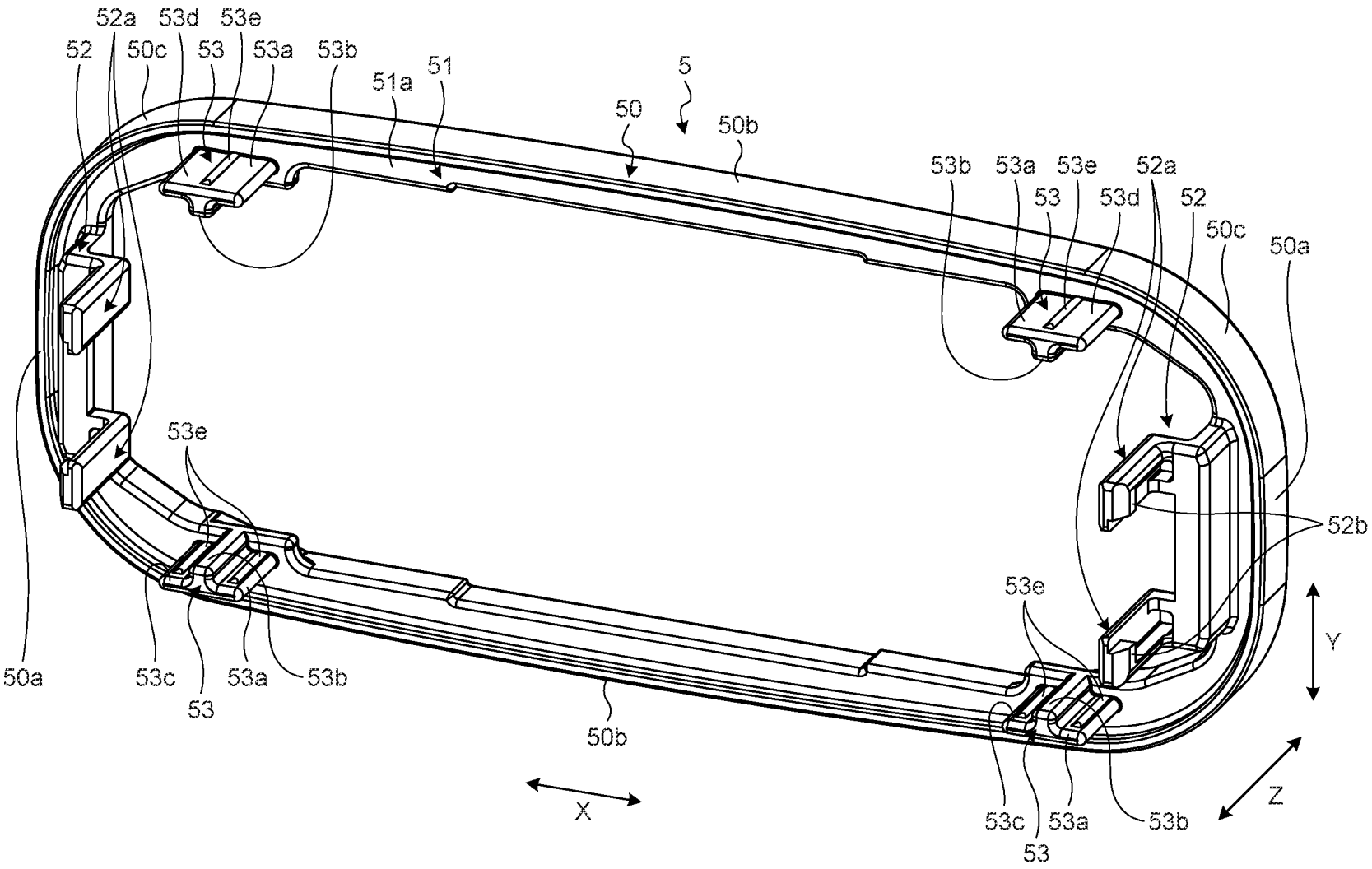
FIG. 9 is a perspective view of a holder according to the embodiment.
Figure 10:
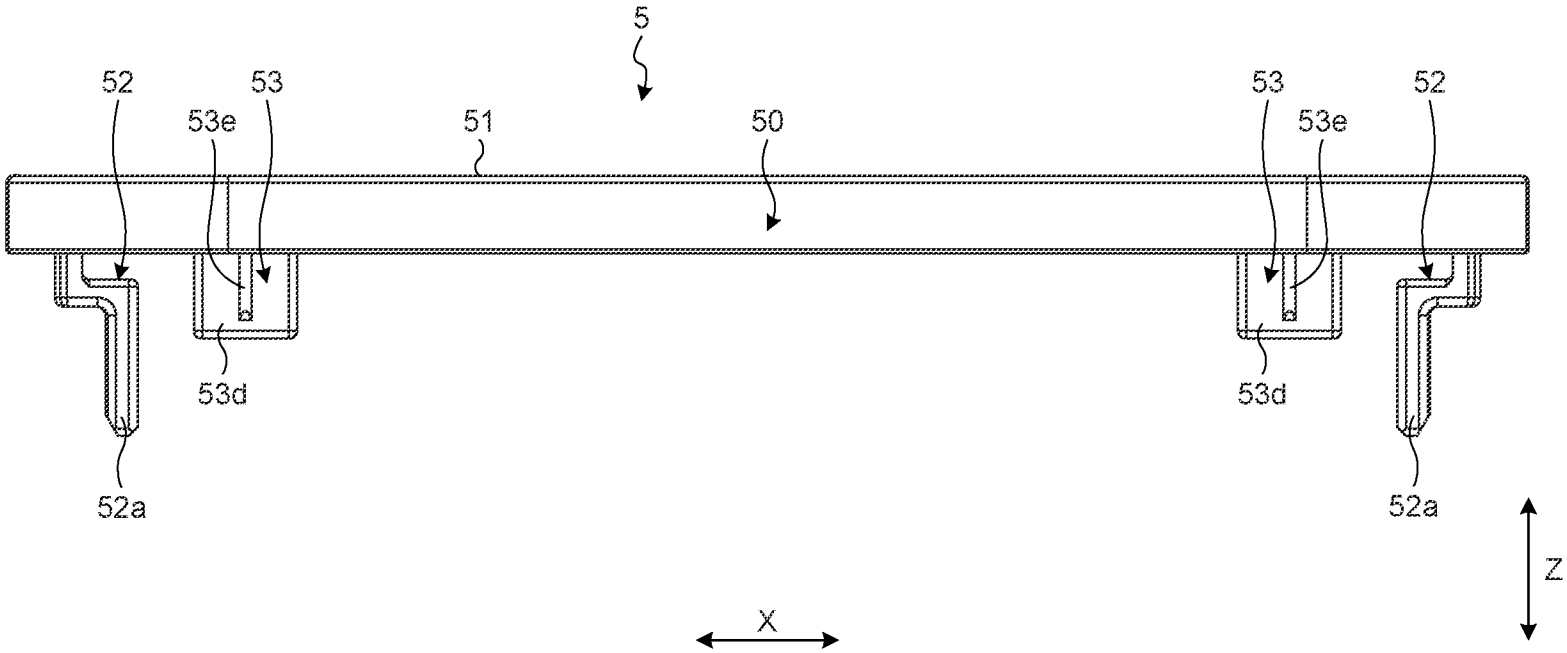
FIG. 10 is a side view of the holder according to the embodiment.

The following describes the embodiment with reference to FIG. 1 to FIG. 22. The present embodiment relates to a connector. FIG. 1 is a perspective view illustrating the connector according to the embodiment, FIG. 2 is a diagram illustrating an inner housing to be inserted into an outer housing, FIG. 3 is an exploded perspective view of the connector according to the embodiment, FIG. 4 is a front view of the outer housing according to the embodiment, FIG. 5 is a perspective view of the outer housing according to the embodiment, FIG. 6 is a side view of the outer housing according to the embodiment, FIG. 7 is a perspective view of a sealing member according to the embodiment, FIG. 8 is a side view of the sealing member according to the embodiment, FIG. 9 is a perspective view of a holder according to the embodiment, and. FIG. 10 is a side view of the holder according to the embodiment.

Figure 11:
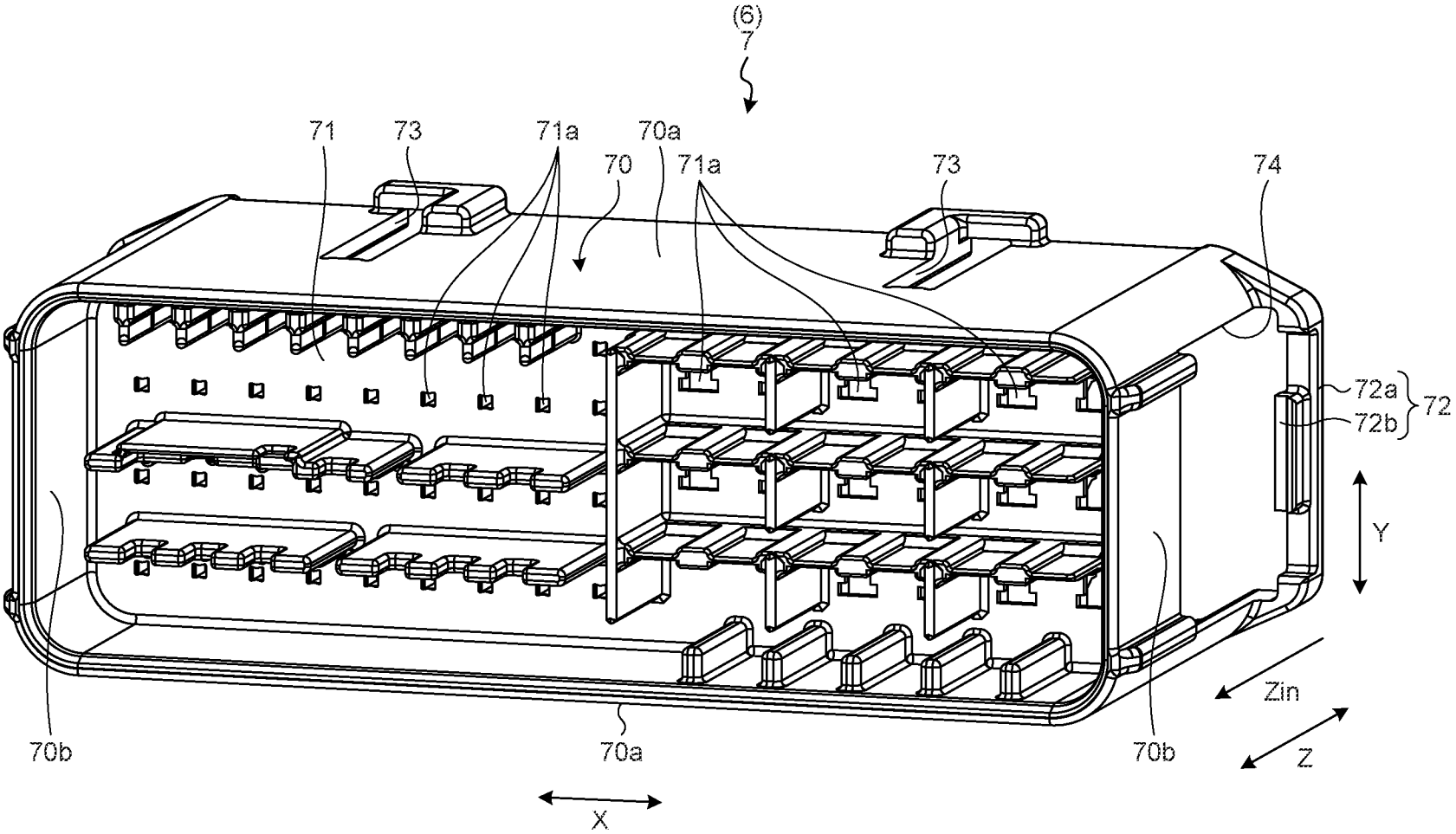
FIG. 11 is a perspective view of an outer shell part of the inner housing according to the embodiment.
Figure 12:
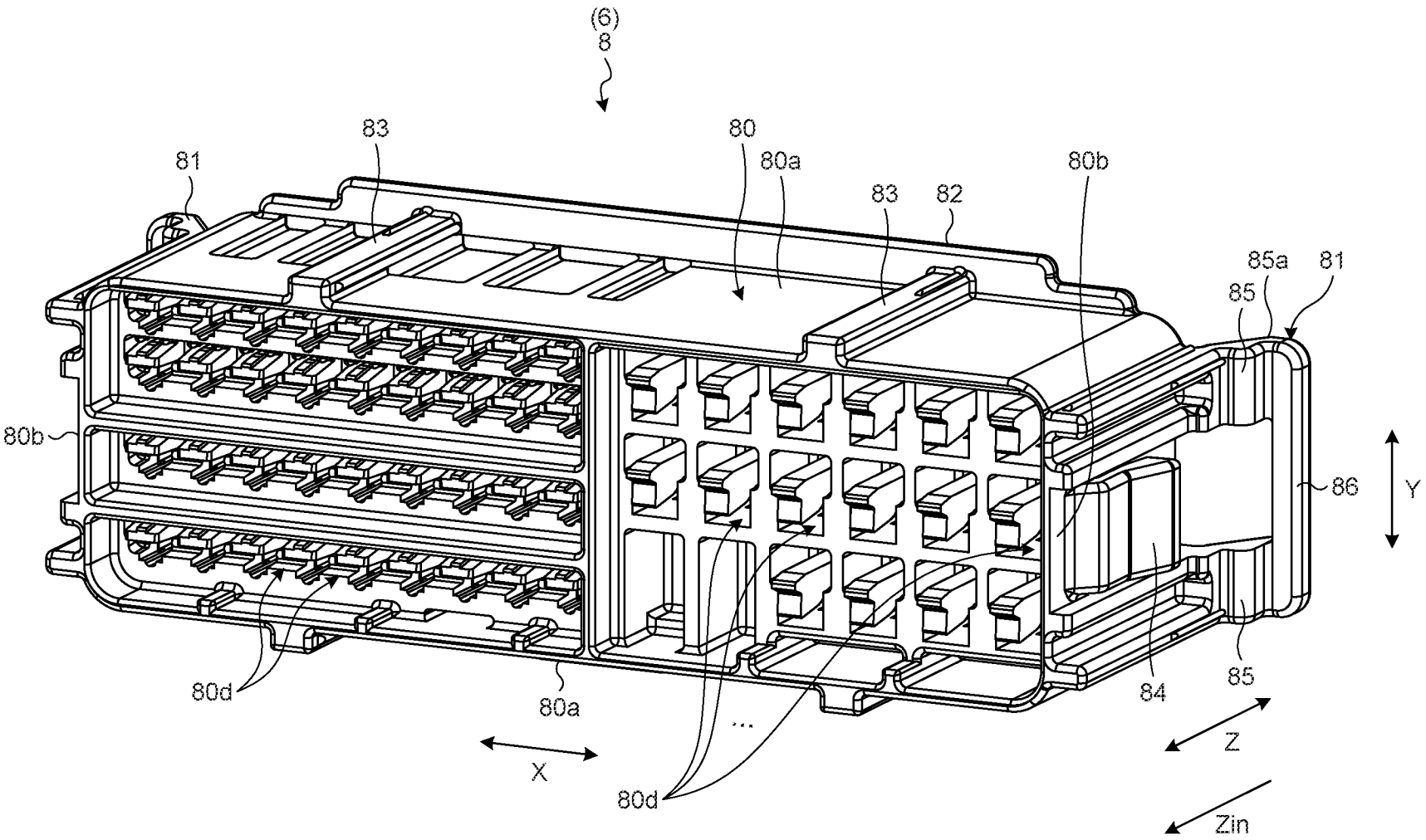
FIG. 12 is a perspective view of a holding body of the inner housing according to the embodiment.
Figure 13:
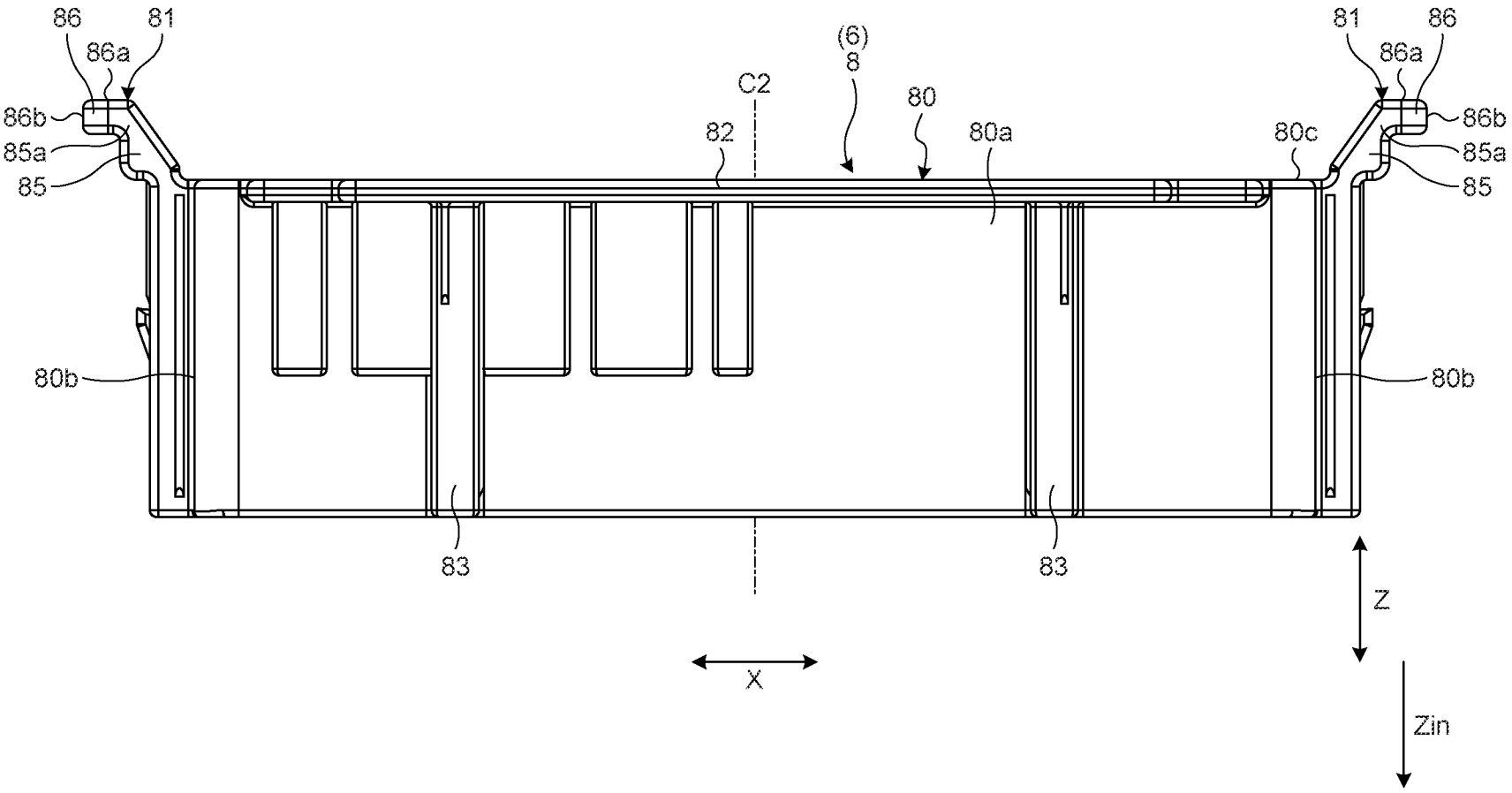
FIG. 13 is a plan view of the holding body according to the embodiment.
Figure 14:
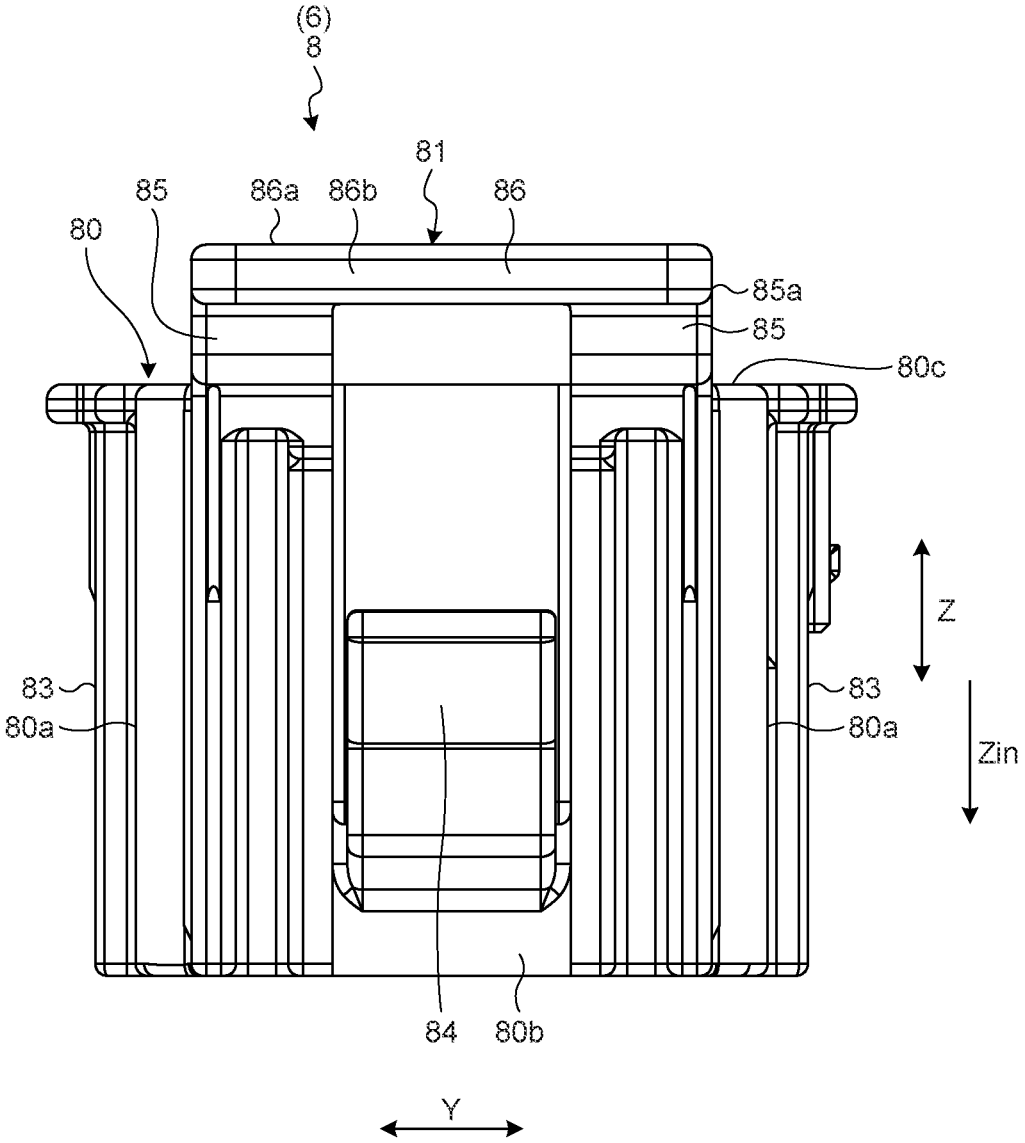
FIG. 14 is a side view of the holding body according to the embodiment.
Figure 15:
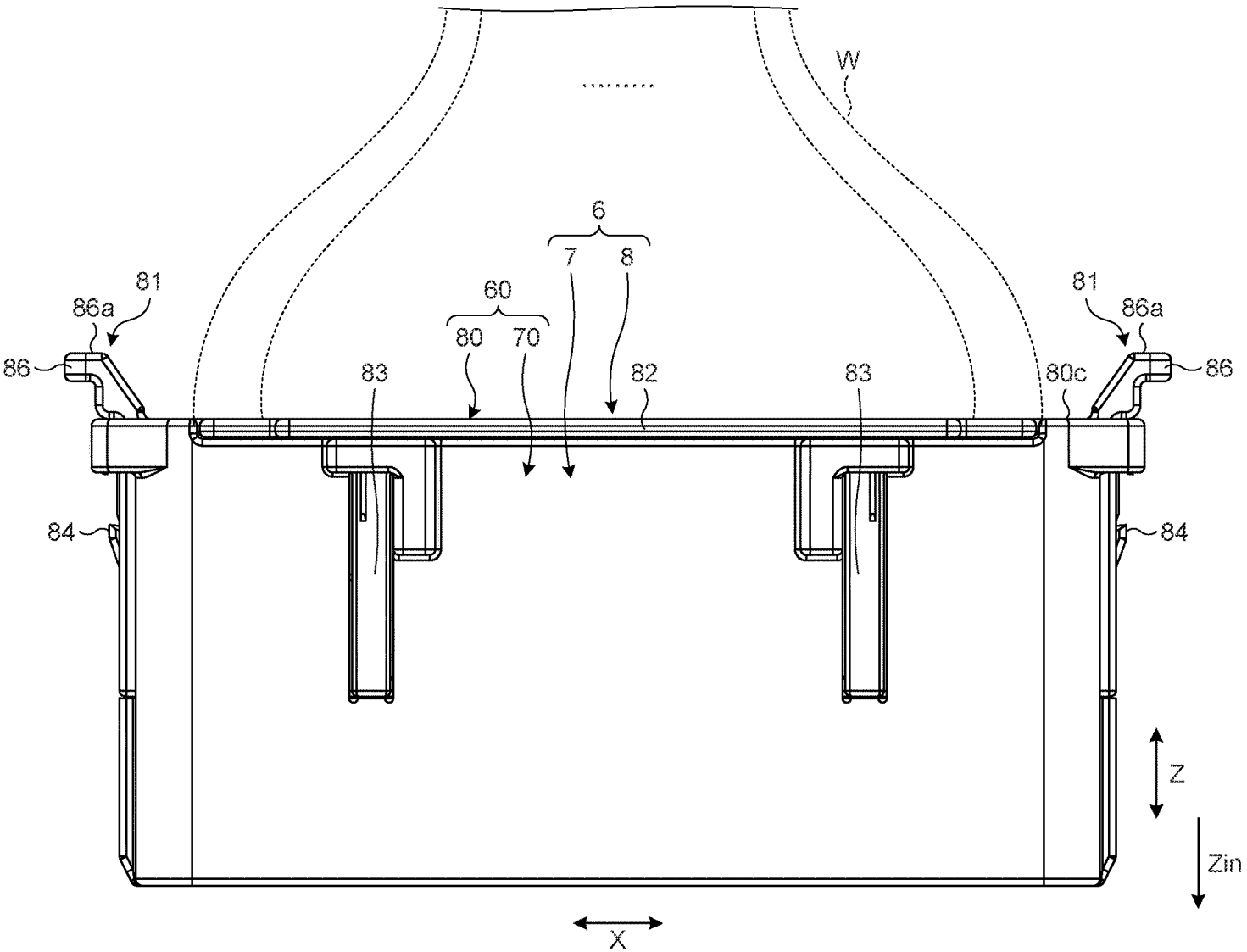
FIG. 15 is a plan view of the inner housing according to the embodiment.
Figure 16:
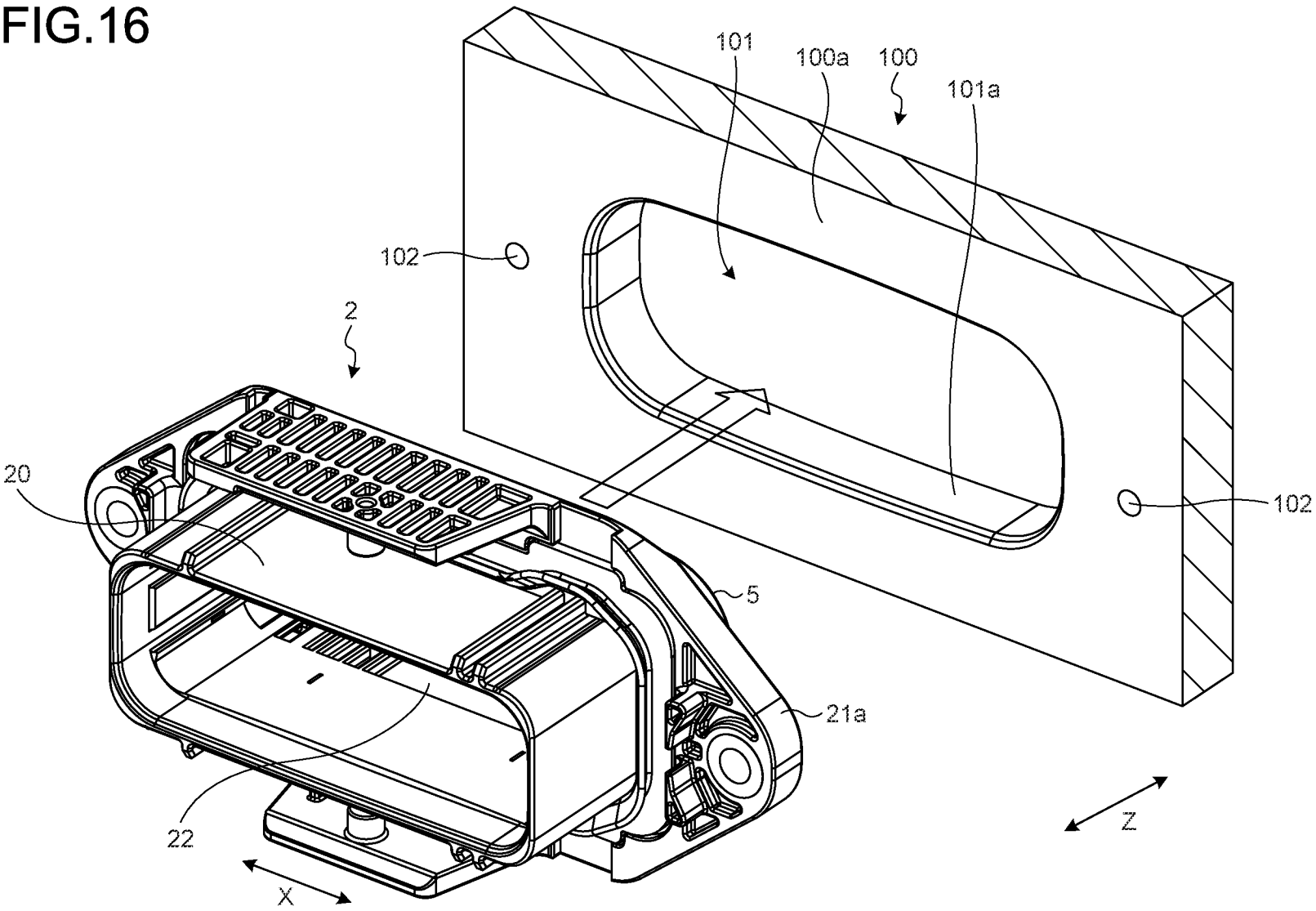
FIG. 16 is a perspective view illustrating the outer housing to be inserted into a hole part.
Figure 17:
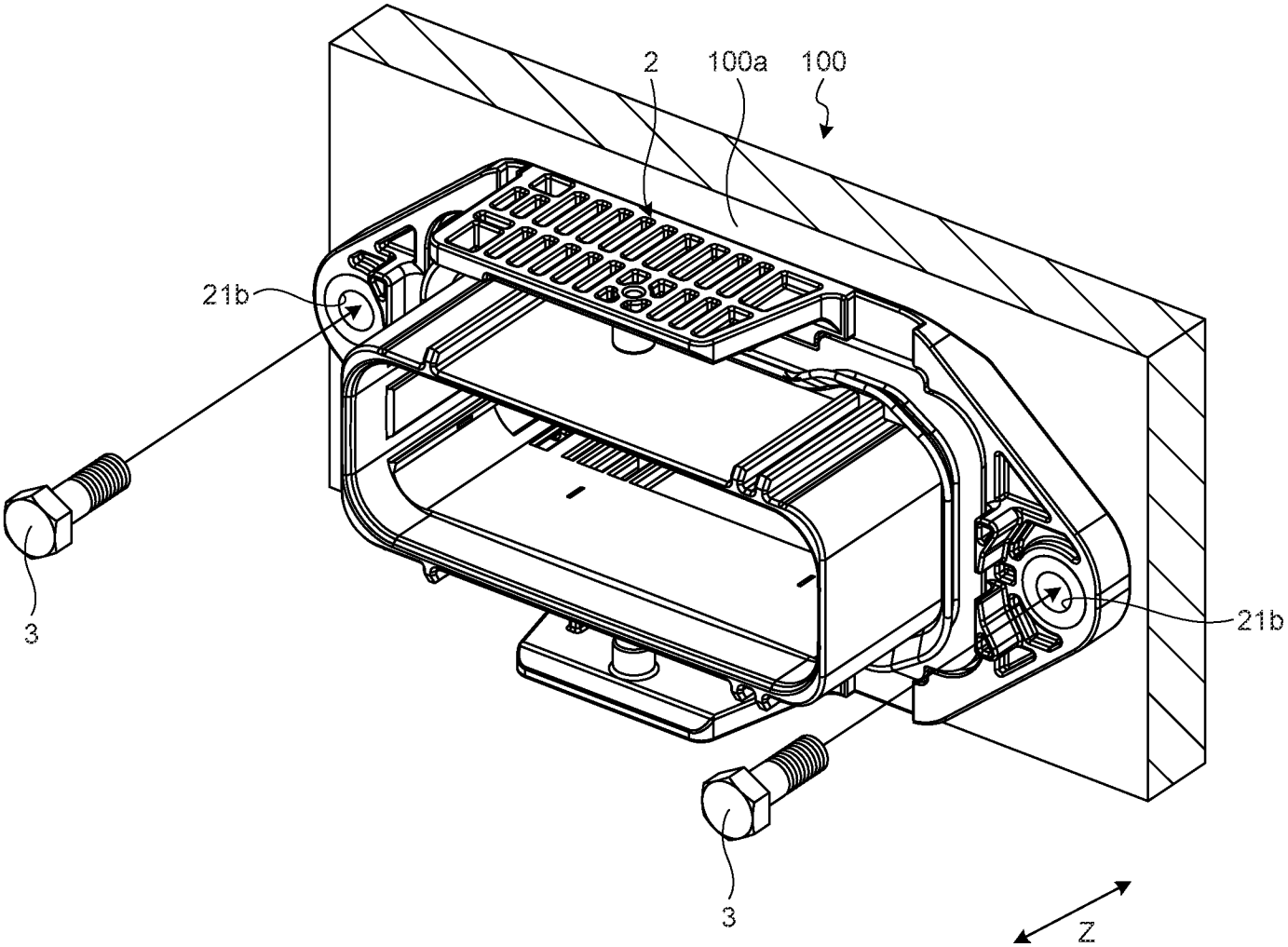
FIG. 17 is a perspective view illustrating fastening of bolts to a wall part.
Figure 18:
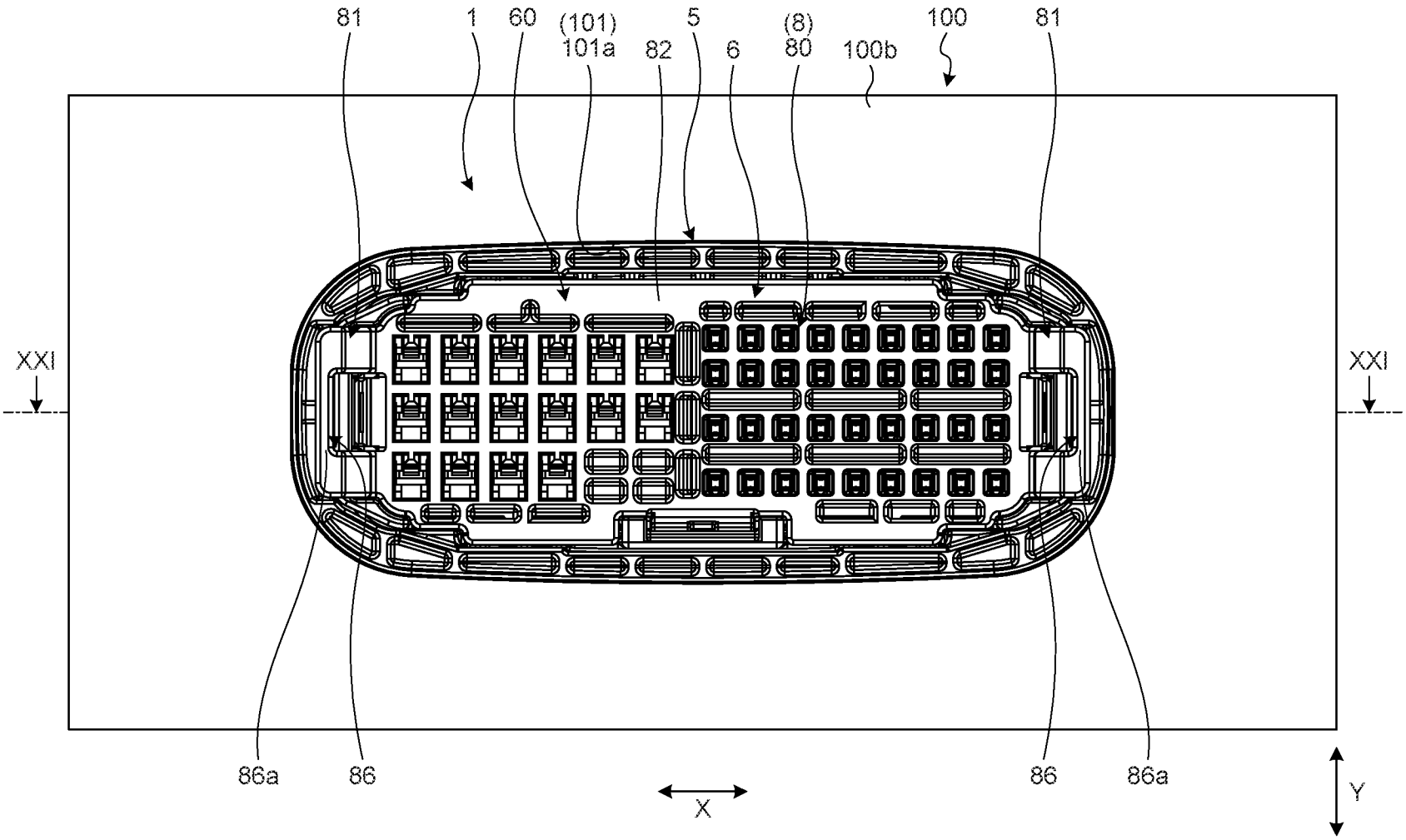
FIG. 18 is a back view illustrating the connector fixed to the wall part.
Figure 19:
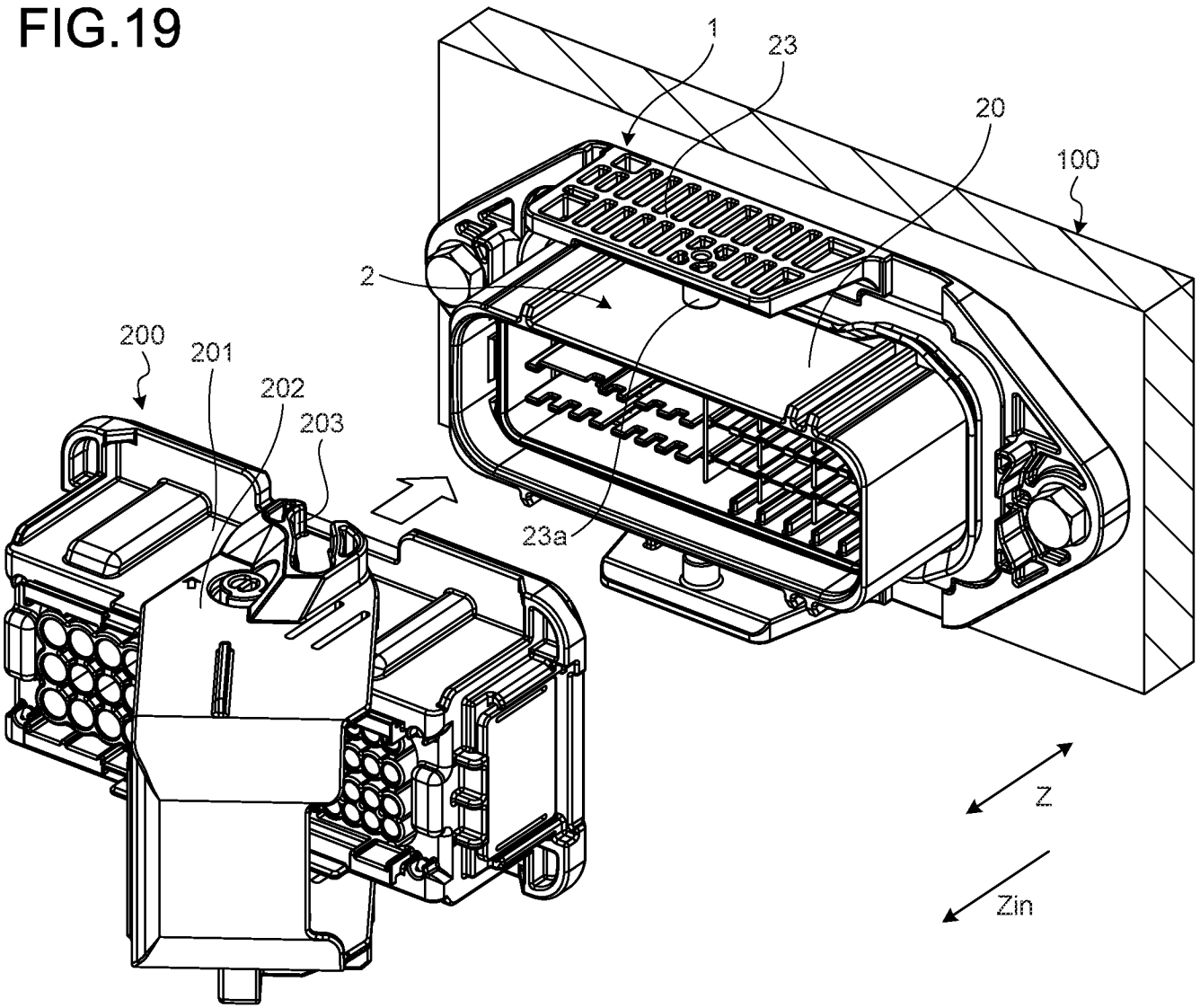
FIG. 19 is a perspective view illustrating a counterpart connector to be connected to the connector according to the embodiment.

FIG. 11 is a perspective view of an outer shell part of the inner housing according to the embodiment, FIG. 12 is a perspective view of a holding body of the inner housing according to the embodiment, FIG. 13 is a plan view of the holding body according to the embodiment, FIG. 14 is a plan view of the holding body according to the embodiment, FIG. 15 is a plan view of the inner housing according to the embodiment, FIG. 16 is a perspective view illustrating the outer housing to be inserted into a hole part, FIG. 17 is a perspective view illustrating fastening of bolts to a wall part, FIG. 18 is a back view illustrating the connector fixed to the wall part, and FIG. 19 is a perspective view illustrating a counterpart connector to be connected to the connector according to the present embodiment.

Figure 20:
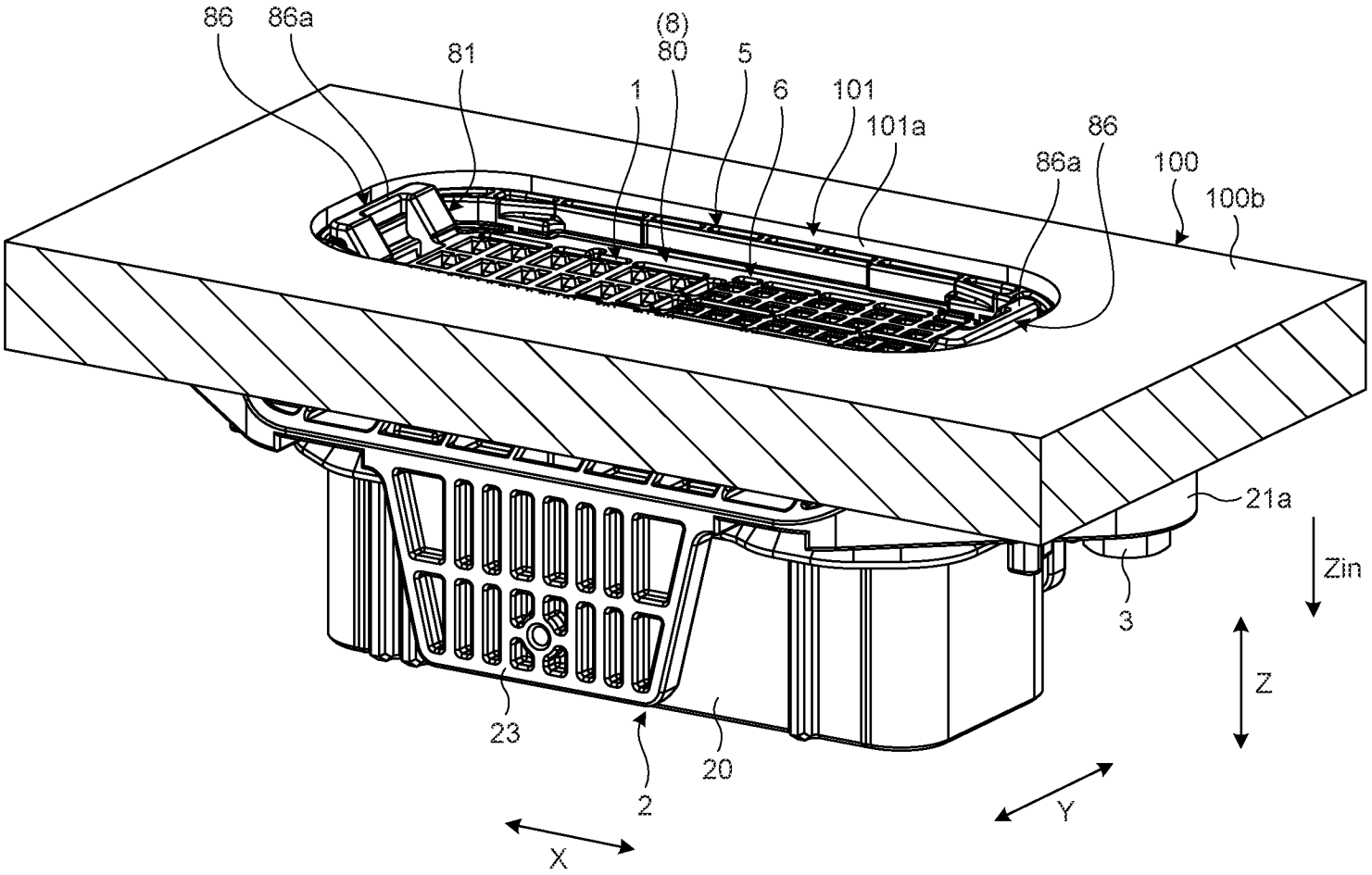
FIG. 20 is a perspective view of the connector fixed to the wall part.
Figure 21:
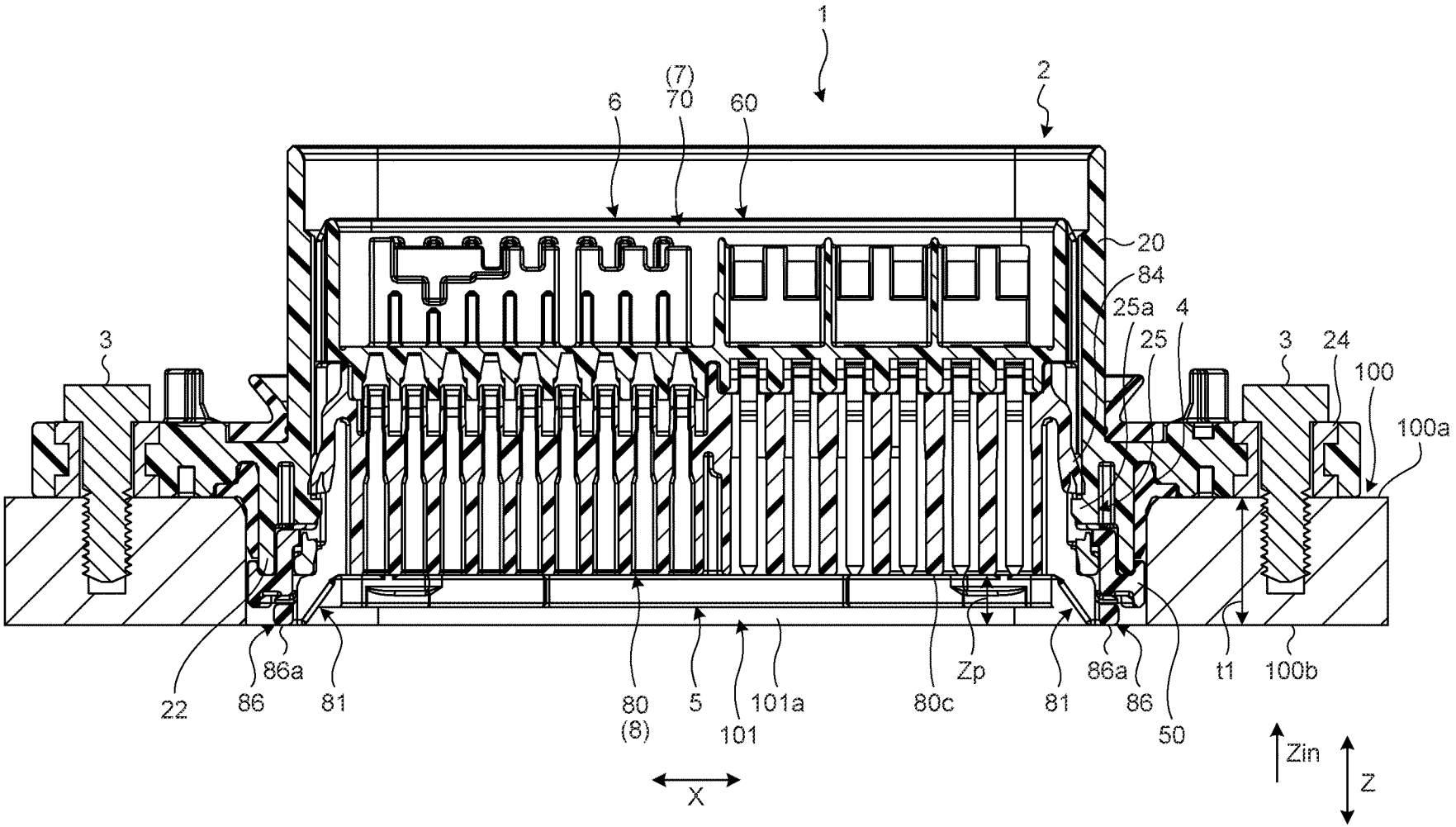
FIG. 21 is a sectional view of the connector and the wall part in a completely engaged state.
Figure 22:
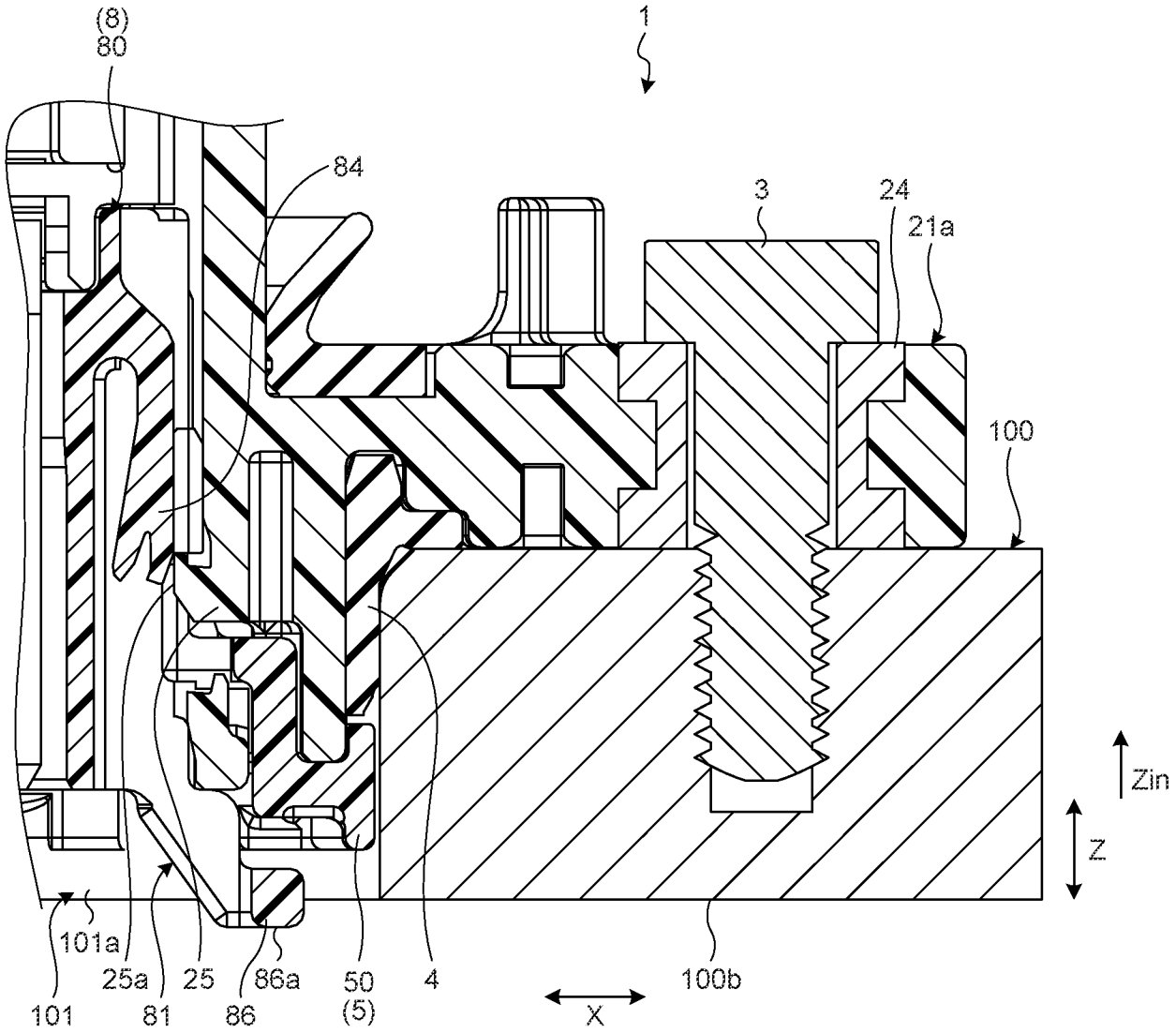
FIG. 22 is a sectional view of the connector and the wall part that are not completely engaged with each other.

FIG. 20 is a perspective view of the connector fixed to the wall part, FIG. 21 is a sectional view of the connector and the wall part in a completely engaged state, and FIG. 22 is a sectional view of the connector and the wall part that are not completely engaged with each other. FIG. 21 illustrates an XXI-XXI section in FIG. 18.

As illustrated in FIG. 1 and FIG. 2, a connector 1 according to the present embodiment is fixed to a wall part 100. The wall part 100 is, for example, part of a housing of a device mounted on a vehicle. The wall part 100 may be a wall part constituting a housing of an inverter or a motor. The wall part 100 includes a first surface 100*a* and a second surface 100*b*. The first surface 100*a* is, for example, an outer surface of the housing. The second surface 100*b* is, for example, an inner surface of the housing. As illustrated in FIG. 2, the wall part 100 includes a hole part 101. The hole part 101 passes through the wall part 100, and opens on each of the first surface 100*a* and the second surface 100*b*. The shape of the hole part 101 according to the present embodiment is a rectangle having four corners that are rounded in a circular arc shape.

As illustrated in FIG. 3, the connector 1 includes an outer housing 2, bolts 3, a sealing member 4, a holder 5, and an inner housing 6, The outer housing 2 includes a main body 20, a flange part 21, an inserting part 22, and a pair of opposed wall parts 23 and 23. The main body 20, the flange part 21, the inserting part 22, and the opposed wall parts 23 are integrally formed by an insulative synthetic resin, for example. The main body 20 has a tubular shape both ends of which are opened, and houses the inner housing 6. A sectional shape of the main body 20 is a rectangle having four corners that are rounded in a circular arc shape.

In the following description, a longitudinal direction on a section of the main body 20 is referred to as a "first direction X", and a lateral direction on the section of the main body 20 is referred to as a "second direction Y". The first direction X and the second direction Y are orthogonal to each other. A direction along a center axis C1 of the main body 20 is referred to as an "axis direction Z". The first direction X and the second direction Y are orthogonal to the axis direction Z. The inner housing 6 is inserted into the outer housing 2 along the axis direction Z. Thus, the first direction X and the second direction Y are orthogonal to an insertion direction Zin of the inner housing 6 with respect to the outer housing 2.

The flange part 21 is connected to one end in the axis direction Z of the main body 20. The flange part 21 projects from an outer surface of the main body 20 in a direction orthogonal to the axis direction Z. The flange part 21 is formed in an annular shape to surround the outer surface of the main body 20.

The inserting part 22 is a portion to be inserted into the hole part 101 of the wall part 100. The inserting part 22 projects from the flange part 21 toward an opposite side of the main body 20 side. The shape of the inserting part 22 is a tubular shape. A sectional shape of a section orthogonal to the axis direction Z of the exemplified inserting part 22 is a rectangle the four corners of which are rounded in a circular arc shape. An outer surface 22*a* of the inserting part 22 is a smooth surface. A pair of engaging parts 25 is disposed on an inner surface of the inserting part 22. The pair of engaging parts 25 is opposed to each other in the first direction X. The engaging parts 25 are engaged with the holder 5 to hold the holder 5.

As illustrated in FIG. 5, guides 27 for positioning the holder 5 are disposed on the inner surface of the inserting part 22. The guides 27 are disposed on a first inner surface 22*c* as a surface along the first direction X. Two guides 27 are disposed on the first inner surface 22*c*. The two guides 27 are disposed at both end parts in the first direction X of the first inner surface 22*c*.

The guide 27 includes a pair of guide walls 26 and 26. The guide wall 26 includes a base 26*a* and an opposed part 26*b*. The base 26*a* projects from the first inner surface 22*c* toward the second direction Y. The opposed part 26*b* projects from a distal end of one base 26*a* toward the other base 26*a* along the first direction X. Distal ends of two opposed parts 26*b* are opposed to each other in the first direction X. The opposed part 26*b* is opposed to the first inner surface 22*c* in the second direction Y. The guide 27 guides a projecting part 53 (refer to FIG. 9) of the holder 5. The guide 27 regulates relative movement of the projecting part 53 with respect to the inserting part 22.

The outer housing 2 includes a pair of fixing parts 21*a*. The fixing parts 21*a* are portions at both ends in the first direction X of the flange part 21. That is, the pair of fixing parts 21*a* is positioned on both sides in the first direction X across the inserting part 22. The fixing part 21*a* is a portion to be fixed to the first surface 100. of the wall part 100. A through hole 21*b*, into which the bolt 3 is inserted is disposed in the fixing part 21*a*. One through hole 21*b* is disposed in each of the fixing parts 21*a*.

The through hole 21*b* according to the present embodiment passes through a collar 24. The collar 24 is a member having a cylindrical shape, and is made of metal, for example. The collar 24 is integrated with the flange part 21 by insert molding and the like. That is, the collar 24 constitutes the fixing part 21*a* together with surrounding resins. The through hole 21*b* passes through the collar 24 along the axis direction Z. A sectional shape of the through hole 21*b* is a circle.

The two through holes 21*b* may be positioned on the same line in the first direction X. For example, the through hole 21*b* of one of the fixing parts 21*a* and the through hole 21*b* of the other one of the fixing parts 21*a* may be positioned on a virtual line L1 along the first direction X.

The pair of opposed wall parts 23 and 23 project from the flange part 21 along the axis direction Z. A projecting direction of the opposed wall part 23 with respect to the flange part 21 is the same as a projecting direction of the main body 20 with respect to the flange part 21. The pair of opposed wall parts 23 and 23 is opposed to each other in the second direction Y across the main body 20. A housing 201 of a counterpart connector 200 (refer to FIG. 19) is inserted between the opposed wall part 23 and the main body 20. The opposed wall part 23 includes a projection 23*a* having a round column shape. The projection 23*a* projects toward the main body 20 along the second direction Y.

The sealing member 4 is mounted on the outer surface 22*a* of the inserting part 22 to seal between the inserting part 22 and the wall part 100. The sealing member 4 is formed by a resin having elasticity such as rubber. As illustrated in. FIG. 7, for example, the shape of the sealing member 4 is an annular shape. The sealing member 4 includes a first sealing part 40 and a second sealing part 41. The first sealing part 40 is a portion functioning as an axis seal. The second sealing part 41 is a portion functioning as a surface seal.

The shape of the first sealing part 40 is a tubular shape having a center axis along the axis direction Z. The first sealing part 40 is mounted on the outer surface 22*a* of the inserting part 22. That is, the inserting part 22 is inserted into the first sealing part 40. A lip 40*a* is formed on an outer surface of the first sealing part 40. The lip 40*a* is disposed over the entire circumference of the outer surface of the first sealing part 40. The first sealing part 40 seals between the outer surface 22*a* of the inserting part 22 and a wall surface 101*a* of the hole part 101.

The second sealing part 41 projects from the outer surface of the first sealing part 40 toward a direction orthogonal to the axis direction Z. The shape of the second sealing part 41 is an annular shape. That is, the second sealing part 41 is disposed over the entire circumference of the outer surface of the first sealing part 40. The second sealing part 41 seals between the flange part 21 of the outer housing 2 and the first surface 100*a* of the wall part 100.

The holder 5 is a member that is fixed to a distal end part of the inserting part 22. The holder 5 has a function of holding the sealing member 4, a function of protecting the sealing member 4, and a function of suppressing eccentricity of the inserting part 22 with respect to the hole part 101. As illustrated in FIG. 9 and FIG. 10, the holder 5 includes an abutting part 50, an annular part 51, engaging parts 52, and projecting parts 53. The abutting part 50, the annular part 51, the engaging parts 52, and the projecting parts 53 are integrally formed by an insulative synthetic resin, for example.

The abutting part 50 is a portion that abuts on the wall surface 101*a* of the hole part 101 to regulate relative movement of the inserting part 22 with respect to the hole part 101. The exemplified abutting part 50 has a tubular shape, and is configured to cover the outer surface 22*a* of the inserting part 22. The shape of the abutting part 50 in a case of being viewed from the axis direction Z is a rectangle having four rounded corners. The abutting part 50 includes a first abutting surface 50*a* and a second abutting surface 50*b*.

The first abutting surface 50*a* is a surface facing the first direction X in a state in which the holder 5 is fixed to the inserting part 22. Thus, the first abutting surface 50*a* is opposed to the wall surface 101*a* of the hole part 101 in the first direction X. The first abutting surface 50*a* is, for example, a plane.

The second abutting surface 50*b* is a surface facing the second direction Y in a state in which the holder 5 is fixed to the inserting part 22. Thus, the second abutting surface 50*b* is opposed to the wall surface 101*a* of the hole part 101 in the second direction Y. The second abutting surface 50*b* is, for example, a curved surface that is slightly curved outward. The second abutting surface 50*b* may be substantially a flat surface.

The abutting part 50 includes curved surfaces 50*c* that connect the first abutting surface 50*a* with the second abutting surface 50*b*. The curved surfaces 50*c* are disposed at four corner parts of the abutting part 50. The curved surface 50*c* is curved outward, and has a substantially circular ark shape, for example.

The annular part 51 is a portion opposed to a distal end surface 22*b* of the inserting part 22. The shape of the annular part 51 in a case of being viewed from the axis direction Z is a rectangle having four rounded corners. The annular part 51 is formed to cover and hide the distal end surface 22*b*. The abutting part 50 projects from an opposed surface 51*a* of she annular part 51 along the axis direction Z. The opposed surface 51*a* is a surface of the annular part 51 on a side opposed to the distal end surface 22*b*. The abutting part 50 projects from an outer edge of the opposed surface 51*a* toward the axis direction Z.

The engaging part 52 projects from the opposed surface 51*a* of the annular part 51 toward the axis direction Z. The engaging parts 52 are respectively disposed on two short side portions included in the annular part 51. The engaging part 52 includes a pair of flexible arms 52*a*. The pair of arms 52*a* are arranged side by side along the second direction Y. A pawl 52*b* is formed on a distal end part of the arm 52*a*. The pawl 52*b* is engaged with the engaging part 25 of the inserting part 22, and is locked by the engaging part 25.

The projecting part 53 projects from the opposed surface 51*a* of the annular part 51 toward the axis direction Z. The projecting parts 53 are respectively disposed on two long side portions included in the annular part 51. A pair of the projecting parts 53 is disposed on one long side portion. The pair of the projecting parts 53 is disposed on both ends of the long side portion. The projecting part 53 includes a main part 53*a* and a projection 53*b*. The shape of the main part 53*a* is a rectangular flat plate shape. A principal plane of the main part 53*a* faces the second direction Y. That is, the main part 53*a* extends in a direction orthogonal to the second direction Y.

The main part 53*a* includes a first surface 53*c* and a second surface 53*d*. The first surface 53*c* is a surface facing an inner side of the holder 5 of two principal planes included in the main part 53*a*. The second surface 53*d* is a surface facing an outer side of the holder 5. The projection 53*b* projects from the first surface 53*c* of the main part 53*a*. The projection 53*b* extends along the axis direction Z from a base end to a distal end of the main part 53*a*. Squeezing ribs 53*e* extending along the axis direction Z are disposed on the first surface 53*c* and the second surface 53*d*. The squeezing rib 53*e* can be plastically deformed when the projecting part 53 is inserted into the guide 27. The squeezing rib 53*e* suppress play between the projecting part 53 and the guide 27.

The inner housing 6 according to the present embodiment includes an outer shell part 7 illustrated in FIG. 11, and a holding body 8 illustrated in FIG. 12 to FIG. 14. As illustrated in FIG. 11, the outer shell part 7 includes an external wall part 70 having a tubular shape, and a partition wall 71. The external wall part 70 and the partition wall 71 are integrally formed by an insulative synthetic resin, for example. A sectional shape of the external wall part 70 on a section orthogonal to the axis direction Z is a rectangle having four rounded corners. The external wall part 70 includes a pair of first wall parts 70*a* and 70*a*, and a pair of second wall parts 70*b* and 70*b*. The pair of first wall parts 70*a* and 70*a* extends along the first direction X, and is opposed to each other in the second direction Y. The pair of second wall parts 70*b* and 70*b* extends along the second direction Y, and is opposed to each other in the first direction X.

The partition wall 71 is orthogonal to the axis direction Z, and partitions a space part surrounded by the external wail part 70. The partition wall 71 is connected to the pair of first wall parts 70*a* and 70*a* and the pair of second wall parts 70*b* and 70*b*. The partition wall 71 includes a plurality of through holes 71*a*. A terminal of the connector 1 is inserted into the through hole 71*a*. The terminal held by the connector 1 is, for example, a male terminal.

A slit 73 extending along the axis direction Z is formed in the first wall part 70*a*. The slit 73 extends from a rear end in the insertion direction Zin of the first wall part 70*a* toward the insertion direction Zin. Two slits 73 are disposed in one first wall part 70*a*. A notch 74 opening toward a rear side in the insertion direction Zin is formed on the second wall part 70*b*.

Engaging parts 72 are disposed at a rear end in the insertion direction. Zin of the external wall part 70. The engaging parts 72 are disposed at both ends in the first. direction X of the external wall part 70. The engaging part 72 includes an arch part 72*a* and a projection 72*b*. The arch part 72*a* connects the pair of first wall parts 70*a* and 70*a* across the notch 74. The projection 72*b* projects from a center part of the arch part 72*a* toward the insertion direction Zin.

As illustrated in FIG. 12, the holding body 8 of the inner housing 6 includes a main body 80 and a projecting part 81. The main body 80 and the projecting part 81 are, for example, integrally formed by an insulative synthetic resin. The main body 80 is a portion to be engaged with the outer shell part 7. The shape of the exemplified main body 80 is a substantially rectangular parallelepiped shape. The main body 80 includes a plurality of cavities 80*d*. The cavity 80*d* passes through the main body 80 along the axis direction Z. The terminal of the connector 1 is inserted into the cavity 80*d* to be held by the cavity 80*d*.

An outer wall surface of the main body 80 includes a pair of first wall surfaces 80*a* and 80*a*, and a pair of second wall surfaces 80*b* and 80*b*. The first wall surface 80*a* is a wall surface extending along the first direction X, and faces the second direction Y. The second wall surface 80*b* is a wall surface extending along the second direction Y, and faces the first direction X. A plate part 82 is disposed at a rear end in the insertion direction Zin of the main body 80. The plate part 82 projects from the first wall surface 80*a* toward the second direction Y. Ribs 83 are formed on the first wall surface 80*a*. The ribs 83 are connected to the plate part 82, and extend along the axis direction Z. The two ribs 83 are disposed on each. first wall surface 80*a*. The rib 83 is inserted into the slit 73 of the outer shell part 7.

A flexible arm 84 is disposed on each second wall surface 80*b*. The arm 84 is connected to a front side portion in the insertion direction Zin of the second wall surface 80*b*. The arm 84 extends along the axis direction Z toward a rear side in the insertion direction Zin. The arm 84 is engaged with the engaging part 25 (refer to FIG. 5) of the outer housing 2 when the inner housing 6 is inserted into the outer housing 2. When the inner housing 6 and the outer housing 2 are completely engaged with each other, the arm 84 is locked by the engaging part 25. The engaging part 25 regulates movement of the inner housing 6 in a direction of slipping out of the outer housing 2.

The projecting pare 81 projects from the main body 80 toward a rear side in the insertion direction Zin. One projecting part 81 is disposed for each of both ends in the first direction X of the main body 80. The projecting part 81 includes a pair of bases 85 and 85, and an operation. part 86. The base 85 projects from a rear end 80*c* of the main body 80 toward a rear side in the insertion direction Zin. The base 85 is connected to the second wall surface 80*b*, and extends in a direction inclined with respect to the second wall surface 80*b*. That is, the base 85 is inclined to become more distant from the second wall surface 80*b* toward a rear side in the insertion direction Zin.

The operation part 86 connects the pair of bases 85 and 85 along the second direction Y. Both ends of the operation part 86 in the second direction Y are connected to end parts of the bases 85. The shape of the operation part 86 is a flat plate shape or a rectangular column shape. The operation part 86 projects and extends from a rear end 85*a* in the insertion direction Zin of the base 85 toward the first direction X. An extending direction of the operation part 86 is a direction to be more distant from the main body 80 along the first direction X. As illustrated in FIG. 13, for example, the operation part 86 includes a rear end surface 86*a* facing a rear side in the insertion direction Zin, and a side surface 86*b*. The side surface 86*b* faces an opposite side of a center axis C2 side of the main body 80 in the first direction X.

The operation part 86 is formed to be easily held by an operator. For example, at the time of assembling the inner housing 6 to the outer housing 2, the operator holds a pair of the operation parts 86. The operator may sandwich the pair of operation parts 86 by one hand, or may hold the two operation parts 86 by different hands. Additionally, at the time of inserting the inner housing 6 into the cuter housing 2, the operator can push the rear end surface 86*a*. The rear end surface 86*a* is a plane, so that the operator can easily push the rear end surface 86*a*. The pair of the operation parts 86 is positioned on both ends in the longitudinal direction of the main body 80. Thus, the operator can uniformly apply pressing force to the inner housing 6 via two rear end surfaces 86*a*.

FIG. 15 illustrates the inner housing 6 to which the outer shell part 7 and the holding body 8 are assembled. The external wall part 70 of the outer shell part 7 and the main body 80 of the holding body 8 constitute a main body 60 of the inner housing 6. An electric wire W connected to the terminal projects from the rear end 80*c* of the holding body 8 toward the outside. The operation part 86 projects from the main body 60 toward a rear side in the insertion direction Zin. The operation part 86 projects from the main body 60 along the first direction X. Thus, the operation part 86 hardly interferes with the electric wire W. The operator can easily assemble the inner housing 6 to the outer housing 2 while holding the operation parts 86.

The following describes an assembling method for the connector 1 according to the present embodiment. First, as illustrated in FIG. 16, the outer housing 2 is attached to the wall part 100. The inserting part 22 of the outer housing 2 has the sealing member 4 and the holder 5 attached thereto. The operator inserts the inserting part 22 into the hole part 101. The operator inserts the inserting part 22 into the hole part 101 to reach a position where the fixing part 21*a* abuts on the first surface 100*a*, for example.

Next, as illustrated in FIG. 17, the outer housing 2 is fixed to the wall part 100 by the bolts 3. The bolt 3 is inserted into the through hole 21*b* of the outer housing 2, and is screwed into a screw hole 102 of the wall part 100. The fixing parts 21*a* of the outer housing 2 are fastened to the wall part 100 by the two bolts 3

Next, as illustrated in FIG. 2, the inner housing 6 is inserted into the outer housing 2. The inner housing 6 is inserted into the hole part 101 and the outer housing 2 from the second surface 100*b* side. When the inner housing 6 is inserted into the outer housing 2 to reach a completely engaged position, the flexible arm 84 is engaged with the engaging part 25. When the inner housing 6 is completely engaged with the outer housing 2, assembly of the connector 1 according to the embodiment is completed. FIG. 18 illustrates the connector 1 after the inner housing 6 is assembled to the outer housing 2. FIG. 18 illustrates the connector 1 viewed from a side of the second surface 100*b* of the wall part 100. The shape of the main body 60 of the inner housing 6 in a case of being viewed from the axis direction Z is a flat shape the longitudinal direction of which is the first direction X.

FIG. 19 illustrates the counterpart connector 200 corresponding to the connector 1 according to the present embodiment. As illustrated in FIG. 19, the counterpart connector 200 is connected to the connector 1 fixed to the wall part 100. The counterpart connector 200 is what is called a lever-type connector, and includes the housing 201 and a lever 202. The housing 201 holds a terminal, and is engaged with the outer shell part 7 of the inner housing 6. When the housing 201 is engaged with the inner housing 6, the terminal held by the housing 201 and a terminal held by the holding body 8 are physically and electrically connected with each other. The lever 202 is coupled to the housing 201, and supported by the housing 201 in a rotatable manner. The lever 202 includes a guide groove 203.

When the housing 201 is engaged with the inner housing 6, the projection 23*a* is inserted into the guide groove 203. When the lever 202 is rotated thereafter, the guide groove 203 draws the projection 23*a* to completely engage the housing 201 with the inner housing 6. The counterpart connector 200 can completely engage the housing 201 with the inner housing 6 with small force using the principle of the lever.

As described below, the connector 1 according to the present embodiment is configured such that whether the inner housing 6 is completely engaged with the outer housing 2 can be visually checked. FIG. 20 and FIG. 21 illustrate the inner housing 6 completely engaged with the outer housing 2. In the following description, a state in which the outer housing 2 is completely engaged with the inner housing 6 in the connector 1 is simply referred to as a "completely engaged state".

For example, as illustrated in FIG. 21, the completely engaged state is a state in which the arm 84 of the inner housing 6 is engaged with the engaging part 25 of the outer housing 2. When the inner housing 6 is inserted into the outer housing 2, the arm 84 gets over a projection 25*a* of the engaging part 25 while being distorted and deformed. In the completely engaged state, the projection 25*a* is opposed to the distal end surface of the arm 84 in the axis direction Z. When the inner housing 6 attempts to move in a direction of falling out of the completely engaged position, the projection 25*a* locks the arm 84 to regulate movement of the inner housing 6. When the inner housing 6 is completely engaged with the outer housing 2, the plate part 82 of the inner housing 6 abuts on the inserting part 22 of the outer housing 2. That is, the inserting part 22 has a function as a stopper that locks the plate part 82 in the axis direction Z.

As illustrated in FIG. 21, the projecting part 81 according to the present embodiment is configured such that the rear end surface 86*a* of the projecting part 81 and the second surface 100*b* of the wall part 100 are located to be flush with each other in the completely engaged state. The shape of the projecting part 81 is, for example, defined corresponding to a plate thickness t1 of the wall part 100. The projecting part 81 projects from the rear end 80*c* of the holding body 8 toward a rear side in the insertion direction Zin. A projecting amount Zp of the projecting part 81 with respect to the rear end 80*c* is defined such that the rear end surface 86*a* and the second surface 100*b* are located to be flush with each other in the completely engaged state.

Thus, the operator can determine that the state is the completely engaged state if the rear end surface 86*a* and the second surface 100*b* are located to be flush with each other at the time of engaging the inner housing 6 with the outer housing 2. With the connector 1 according to the present embodiment, whether the inner housing 6 is completely engaged with the outer housing 2 can be easily determined by visual check.

FIG. 22 illustrates an incompletely engaged state in which the inner housing 6 is not completely engaged with the outer housing 2. In the connector 1 illustrated in FIG. 22, the arm 84 of the inner housing 6 does not get over the projection 25*a* of the outer housing 2. Before the inner housing 6 is completely engaged with the outer housing 2, as illustrated in FIG. 22, the projecting part 81 of the inner housing 6 projects from the hole part 101 toward the axis direction Z. The rear end surface 86*a* of the projecting part 81 is positioned on a rear side in the insertion direction Zin of the second surface 100*b* of the wall part 100. That is, there is a level difference that can be identified by visual check between the rear end surface 86*a* and the second surface 100*b*. The operator can recognize that the inner housing 6 is not completely engaged with the outer housing 2 when the rear end surface 86*a* projects from the hole part 101.

In this way, with the connector 1 according to the present embodiment, the operator or a tester can easily determine whether the inner housing 6 is completely engaged. with the outer housing 2 by visual check. Thus, the connector 1 according to the present embodiment can improve workability of work of engaging the inner housing 6 with the outer housing 2. Additionally, the connector 1 according to the present embodiment can improve reliability of engaging work, and achieve quality improvement of the connector 1.

The inner housing 6 is designed such that the rear end surface 86*a* and the second surface 100*b* are located to be flush with each other in a case in which dimensions of parts of the inner housing 6 are equal to respective designed dimensions. Thus, even in the completely engaged state, the rear end surface 86*a* and the second surface 100*b* are not located to be flush with each other in some cases due to variations in manufacturing. For example, the rear end surface 86*a* may be positioned slightly forward in the insertion direction Zin, or may be positioned slightly rearward in the insertion direction Zin with respect to the second surface 100*b* in some cases. Even in such a case, if a deviation between the rear end surface 86*a* and the second surface 100*b* in the axis direction Z falls within a tolerance range, it can be said that the rear end surface 86*a* and the second surface 100*b* are substantially flush with each other. That is, even if the position of the rear end surface 86*a* is deviated from the position of the second surface 100*b* within the tolerance range, it can be said that "the projecting part 81 is configured such that the rear end surface 86*a* and the second surface 100*b* are located to be flush with each other in the completely engaged state".

As described above, the connector 1 according to the present embodiment includes the outer housing 2 and the inner housing 6. The outer housing 2 includes the inserting part 22 having a tubular shape. The outer housing 2 is fixed to the first surface 100*a* of the wall part 100 in a state in which the inserting part 22 is inserted into the hole part 101 of the wall part 100. The inner housing 6 includes the main body 60, and the projecting part 81 projecting from the main body 60. The main body 60 is inserted into the hole part 101 from the second surface 100*b* side to be engaged with the outer housing 2.

The projecting part 81 projects from the main body 60 toward a rear side in the insertion direction Zin of the hole part 101. The projecting part 81 is configured such that the rear end surface 86*a* of the projecting part 81 and the second surface 100*b* are located to be flush with each other when the main body 60 is completely engaged with The outer housing 2. With the connector 1 according to the present embodiment, the operator can easily check whether the inner housing 6 is completely engaged with the outer housing 2 by visual check.

The inner housing 6 according to the present embodiment includes a pair of projecting parts 81 and 81. The pair of the projecting parts 81 and 81 are disposed on both ends of the main body 60 in the first direction X orthogonal to the insertion direction Zin. The projecting part 81 is disposed on each end of the main body 60, so that workability of work of engaging the inner housing 6 with the outer housing 2 is improved.

In the present embodiment, the shape of the main body 60 in a case of being viewed from the insertion direction Zin is a flat shape the longitudinal direction of which is the first direction X. The projecting parts 81 are disposed at both ends in the longitudinal direction of the main body 60, so that workability of engaging work is improved.

The projecting part 81 according to the present embodiment includes the base 85 and the operation part 86. The base 85 projects from the main body 60 toward a rear side in the insertion direction Zin. The operation part 86 projects and extends from a rear end in the insertion direction Zin of the base 85 toward the first direction X. The operation part 86 includes the rear end surface 86*a* facing the rear side in the insertion direction Zin, and the side surface 86*b* facing an opposite side of the center axis C2 side of the main body 60 in the first direction X. Due to the projecting part 81 including the rear end surface 86*a* and the side surface 86*b*, workability of engaging work is improved.

In the present embodiment, each of the projecting parts 81 includes the pair of the bases 85 and 85. The pair of the bases 85 and 85 is opposed to each other in the second direction Y that is orthogonal to the first direction X. The operation part 86 connects the pair of the bases 85 and 65 along the second direction Y. Due to the projecting part 81 having such a shape, workability of engaging work is improved.

The disposition and the shape of the projecting part 81 are not limited to the disposition and the shape exemplified in the embodiment. For example, the number of the projecting parts 61 included in the inner housing 6 may be one, or three or more. The number of the bases 85 included in the projecting part 81 may be one, or three or more.

In the inner housing 6, the outer shell part 7 and the holding body 8 may be integrated with each other. That is, the external wall part 70 of the outer shell part 7 may be integrated with the main body 80 of the holding body 8 to configure the main body 60 of the inner housing 6.

The second surface 100*b* of the wall part 100 may have projections and depressions. In other words, the entire region of the second surface 100*b* is not necessarily located to be flush with the rear end surface 86*a* of the inner housing 6. In this case, in the completely engaged state, an edge part of the second surface 100*b* adjacent to the hole part 101 may be located to be flush with the rear end surface 86*a*. In a case of determining whether the state is the completely engaged state, the operator may visually check whether the edge part of the second surface 100*b* and the rear end surface 86*a* of the inner housing 6 are located to be flush with each other.

Pieces of the content disclosed in the embodiment described above can be appropriately combined to be executed.

In the connector according to the present embodiment, the inner housing includes the main body that is inserted into the hole part of the wall part from the second surface side to be engaged with the outer housing, and the projecting part. The projecting part projects from the main body toward the rear side in the insertion direction with respect to the hole part, and is configured such that the rear end surface of the projecting part is located to be flush with the second surface when the main body is completely engaged with the outer housing. The connector according to the present embodiment exhibits an effect of easily determining whether the outer housing and the inner housing are completely engaged with each other by visual check.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

an outer housing that includes an inserting part having a tubular shape, and is fixed to a first surface of a wall part in a state in which the inserting part is inserted into a hole part of the wall part; and an inner housing including a main body that is inserted into the hole part from a second surface side to be engaged with the outer housing, and a projecting part projecting from the main body, wherein the projecting part projects from the main body toward a rear side in an insertion direction with respect to the hole part, and is configured such that a rear end surface of the projecting part is located to be flush with the second surface when the main body is completely engaged with the outer housing.

2. The connector according to claim 1, wherein the inner housing includes a pair of the projecting parts, and the pair of the projecting parts are disposed at both ends of the main body in first direction orthogonal to the insertion direction.

3. The connector according to claim 2, wherein the shape of the main body in a case of being viewed from the insertion direction is a flat shape the longitudinal direction of which is the first direction.

4. The connector according to claim 2, wherein the projecting part includes a base projecting from the main body toward the rear side in the insertion direction, and an operation part projecting and extending from a rear end in the insertion direction of the base toward the first direction, and the operation part includes the rear end surface facing the rear side in the insertion direction, and a side surface facing an opposite side of a center axis side of the main body in the first direction.

5. The connector according to claim 3, wherein the projecting part includes a base projecting from the main body toward the rear side in the insertion direction, and an operation part projecting and extending from a rear end in the insertion direction of the base toward the first direction, and the operation part includes the rear end surface facing the rear side in the insertion direction, and a side surface facing an opposite side of a center axis side of the main body in the first direction.

6. The connector according to claim 4, wherein each of the projecting parts includes a pair of the bases, the pair of the bases is opposed to each other in a second direction orthogonal to the first direction, and the operation part connects the pair of the bases along the second direction.

7. The connector according to claim 5, wherein each of the projecting parts includes a pair of the bases, the pair of the bases is opposed to each other in a second direction orthogonal to the first direction, and the operation part connects the pair of the bases along the second direction.

8. The connector according to claim 1, wherein the inner housing includes an outer shell part that is engaged with a counterpart connector, and a holding body that includes a cavity for housing a terminal and is engaged with the outer shell part, the holding body is inserted into the outer shell part along the insertion direction to be engaged with the outer shell part, and the projecting part is disposed on the holding body.

9. The connector according to claim. 2, wherein the inner housing includes an outer shell part that is engaged with a counterpart connector, and a holding body that includes a cavity for housing a terminal and is engaged with the outer shell part, the holding body is inserted into the outer shell part along the insertion direction to be engaged with the outer shell part, and the projecting part is disposed on the holding body.

10. The connector according to claim 3, wherein the inner housing includes an outer shell part that is engaged with a counterpart connector, and a holding body that includes a cavity for housing a terminal and is engaged with the outer shell part, the holding body is inserted into the outer shell part along the insertion direction to be engaged with the outer shell part, and the projecting part is disposed on the holding body.

11. The connector according to claim 4, wherein the inner housing includes an outer shell part that is engaged with a counterpart connector, and a holding body that includes a cavity for housing a terminal and is engaged with the outer shell part, the holding body is inserted into the outer shell part along the insertion direction to be engaged with the outer shell part, and the projecting part is disposed on the holding body.

12. The connector according to claim 5, wherein the inner housing includes an outer shell part that is engaged with a counterpart connector, and a holding body that includes a cavity for housing a terminal and is engaged with the outer shell part, the holding body is inserted into the outer shell part along the insertion direction to be engaged with the outer shell part, and the projecting part is disposed on the holding body.

13. The connector according to claim 6, wherein the inner housing includes an outer shell part that is engaged with a counterpart connector, and a holding body that includes a cavity for housing a terminal and is engaged with the outer shell part, the holding body is inserted into the outer shell part along the insertion direction to be engaged with the outer shell part, and the projecting part is disposed on the holding body.

14. The connector according to claim 7, wherein the inner housing includes an outer shell part that is engaged with a counterpart connector, and a holding body that includes a cavity for housing a terminal and is engaged with the outer shell part, the holding body is inserted into the outer shell part along the insertion direction to be engaged with the outer shell part, and the projecting part is disposed on the holding body.

* * * * *